US007835671B2

(12) United States Patent
Suzuki

(10) Patent No.: US 7,835,671 B2
(45) Date of Patent: Nov. 16, 2010

(54) DEVELOPING DEVICE USING TWO-COMPONENT DEVELOPER AND IMAGE FORMING APPARATUS EQUIPPED WITH THE DEVELOPING DEVICE

(75) Inventor: Hirokatsu Suzuki, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 455 days.

(21) Appl. No.: 11/773,215

(22) Filed: Jul. 3, 2007

(65) Prior Publication Data

US 2008/0085137 A1 Apr. 10, 2008

(30) Foreign Application Priority Data

Jul. 18, 2006 (JP) ..... 2006-196036

(51) Int. Cl.
*G03G 15/08* (2006.01)

(52) U.S. Cl. ..... 399/254; 399/272

(58) Field of Classification Search ..... 399/254, 399/256, 258, 260, 262, 272–274, 281, 283, 399/284

See application file for complete search history.

(56) References Cited

U.S. PATENT DOCUMENTS

| | | | | |
|---|---|---|---|---|
| 5,937,228 | A | 8/1999 | Shoji et al. | |
| 5,970,280 | A | 10/1999 | Suzuki et al. | |
| 6,035,168 | A * | 3/2000 | Masuda et al. | 399/254 |
| 6,324,369 | B1 * | 11/2001 | Yamaguchi et al. | 399/254 |
| 6,366,751 | B1 | 4/2002 | Shakuto et al. | |
| 6,757,509 | B2 | 6/2004 | Shoji et al. | |
| 7,212,753 | B2 | 5/2007 | Suzuki et | |
| 2005/0254846 | A1 | 11/2005 | Yura et al. | |
| 2007/0014596 | A1 | 1/2007 | Sohmiya et al. | |
| 2007/0025776 | A1 | 2/2007 | Suzuki | |

FOREIGN PATENT DOCUMENTS

| | | |
|---|---|---|
| JP | 11-84874 | 3/1999 |
| JP | 11-133710 | 5/1999 |
| JP | 11-167260 | 6/1999 |
| JP | 2001-249545 | 9/2001 |
| JP | 2001-290369 | 10/2001 |
| JP | 2003-263025 | 9/2003 |
| JP | 2003-263026 | 9/2003 |
| JP | 2004-37516 | 2/2004 |
| JP | 2006-251440 | 9/2006 |

* cited by examiner

*Primary Examiner*—Hoang Ngo
(74) *Attorney, Agent, or Firm*—Oblon, Spivak, McClelland, Maier & Neustadt, L.L.P.

(57) ABSTRACT

A developing device comprises a feeding and conveying path; a stirring and conveying path; and a recovering and conveying path, and capable of extending the service life of a developer and of forming an image with stable image density. In the developing device, the central position of a stirring rotary shaft that is a rotary shaft of a stirring screw and the central position of a feeding rotary shaft that is a rotary shaft of a feed screw are disposed at almost the same height. A recovering rotary shaft that is a rotary shaft of a recovering screw is so disposed that the central position thereof is higher than the central positions of the stirring rotary shaft and feeding rotary shaft, and lower than a rotation central position of the developing rotary shaft that is a rotary shaft of a developing roller.

19 Claims, 21 Drawing Sheets

DEVELOPING DEVICE USING TWO-COMPONENT DEVELOPER AND IMAGE FORMING APPARATUS EQUIPPED WITH THE DEVELOPING DEVICE

BACKGROUND OF THE INVENTION

1. Field of the Invention

The present invention relates to a developing device for use in copiers, facsimile devices, printers, and the like, and more particularly to a development device using a two-component developer comprising a toner and a magnetic carrier, an image forming apparatus using the developing device, and a toner and a carrier for use therein.

2. Description of the Related Art

A developing device using a two-component developer comprising a toner and a magnetic carrier is known. In such a developing device, a developing roller, which is a developer support, supports on the surface thereof a developer comprising a magnetic carrier and a toner with a plurality of magnetic poles provided inside the developing roller and conveys the developer to a zone facing a photosensitive body. A conveying path for feeding the developer to the developing roller and a conveying path for stirring the developer are provided separately from each other, and the developer is circulated by conveying the developer in opposite directions in the two conveying paths.

However, in such conventional developing device, the conveying path for feeding the developer to the developing roller and a conveying path for recovering the developer that was fed to the developing roller and has passed the development region are combined together. The resultant problem is that toner concentration in the developer fed to the developing roller decreases toward the downstream side in the conveying direction of the conveying path for feeding the developer to the developing roller. The decrease in toner concentration in the developer fed to the developing roller results in decreased image density during development.

This problem can be resolved by providing a screw for feeding the developer to the developing roller and a screw for recovering the developer after development in different developer conveying paths, as in the developing devices disclosed in Japanese Patent Applications Laid-open No. H11-167260 (FIG. 1) and 2001-290369 (FIG. 2).

However, in the developing devices suggested in these publications, as will be described below with reference to the appended drawings, excess stress is applied to the developer and shortens the service life thereof. Yet another problem is that toner concentration in the developer on the developing roller becomes uneven and image density becomes non-uniform.

Technologies relating to the present invention are also disclosed in, e.g., Japanese Patent Applications Laid-open No. H11-084874, H11-133710, 2001-249545, 2003-263025, and 2003-263026.

SUMMARY OF THE INVENTION

The present invention was created to resolve the above-described problems inherent to conventional technology, and it is an object of the present invention to provide a developing device comprising a feeding and conveying path, a stirring and conveying path, and a recovering and conveying path that make it possible to extend service life of a developer and form images of stable density, and also to provide an image forming apparatus using such developing device.

In an aspect of the present invention, a developing device comprises a developer support that supports on a surface thereof a developer comprising a magnetic carrier and a toner by a plurality of magnetic poles provided inside the support, and feeds the toner to a latent image on a surface of a latent image support in a location facing the latent image support by rotation of the surface of the developer support; a developer feeding and conveying member that conveys the developer along an axial line direction of the developer support and feeds the developer to the developer support; a developer recovering and conveying member that conveys the developer recovered from the developer support after the developer support passes the location facing the latent image support along the axial line direction of the developer support, in the same direction as the developer feeding and conveying member; and a developer stirring and conveying member that receives a feed of an excess developer that is conveyed to the downstreammost side in the conveying direction of the developer feeding and conveying member, without being fed to the developer support, and a recovered developer that is recovered from the developer support and conveyed to the downstreammost side in the conveying direction of the developer recovering and conveying member, conveys the excess developer and the recovered developer, while stirring the two developers, along the axial line direction of the developer support in the direction opposite that of the developer feeding and conveying member, and feeds the developers to the uppermost side in the conveying direction of the developer feeding and conveying member. Spaces where three development conveying members, which are the developer feeding and conveying member, the developer recovering and conveying member, and the developer stirring and conveying member, are partitioned by a casing and form three developer conveying paths. The three developer conveying paths comprise a developer recovering and conveying path having the developer recovering and conveying member disposed therein, a developer feeding and conveying path having the developer feeding and conveying member disposed therein, and a developer stirring and conveying path having the developer stirring and conveying member disposed therein. End portions of the developer feeding and conveying path and the developer recovering and conveying path on the downstream side in the conveying direction are linked to the end portion of the developer stirring and conveying path on the upstream side in the conveying diction, and an end portion of the developer stirring and conveying path on the downstream side is linked to an end portion of the developer feeding and conveying path on the upstream side in the conveying direction. The three developer conveying members convey the developer in the axial diction of rotary shafts thereof by rotation of the rotary shafts about centers thereof. A central position of the rotation shaft of the developer recovering and conveying member is higher than a central position of the rotation shaft of the developer stirring and conveying member and a central position of the rotation shaft of the developer feeding and conveying member. The central position of the rotation shaft of the developer recovering and conveying member is lower than a central position of a rotation shaft of the developer support.

In another aspect of the present invention, an image forming apparatus comprises at least a latent image support; charging means for charging a surface of the latent image support; latent image forming means for forming an electrostatic latent image on the latent image support; and a developing device for developing the electrostatic latent image and obtaining a toner image. The developing device comprises a developer support that supports on a surface thereof a developer comprising a magnetic carrier and a toner by a plurality of magnetic poles provided inside the support, and feeds the toner to a latent image on a surface of a latent image support in a location facing the latent image support by rotation of the surface of the developer support; a developer feeding and conveying member that conveys the developer along an axial line direction of the developer support and feeds the developer to the developer support; a developer recovering and conveying member that conveys the developer recovered from the developer support after the developer support passes the location facing the latent image support along the axial line direction of the developer support, in the same direction as the developer feeding and conveying member; and a developer stirring and conveying member that receives a feed of an excess developer that is conveyed to the downstreammost side in the conveying direction of the developer feeding and conveying member, without being fed to the developer support, and a recovered developer that is recovered from the developer support and conveyed to the downstreammost side in the conveying direction of the developer recovering and conveying member, conveys the excess developer and the recovered developer, while stirring the two developers, along the axial line direction of the developer support in the direction opposite that of the developer feeding and conveying member, and feeds the developers to the uppermost side in the conveying direction of the developer feeding and conveying member. Spaces where three development conveying members, which are the developer feeding and conveying member, the developer recovering and conveying member, and the developer stirring and conveying member, are partitioned by a casing and form three developer conveying paths. The three developer conveying paths comprise a developer recovering and conveying path having the developer recovering and conveying member disposed therein, a developer feeding and conveying path having the developer feeding and conveying member disposed therein, and a developer stirring and conveying path having the developer stirring and conveying member disposed therein. End portions of the developer feeding and conveying path and the developer recovering and conveying path on the downstream side in the conveying direction are linked to the end portion of the developer stirring and conveying path on the upstream side in the conveying diction, and an end portion of the developer stirring and conveying path on the downstream side is linked to an end portion of the developer feeding and conveying path on the upstream side in the conveying direction. The three developer conveying members convey the developer in the axial diction of rotary shafts thereof by rotation of the rotary shafts about centers thereof. A central position of the rotation shaft of the developer recovering and conveying member is higher than a central position of the rotation shaft of the developer stirring and conveying member and a central position of the rotation shaft of the developer feeding and conveying member. The central position of the rotation shaft of the developer recovering and conveying member is lower than a central position of a rotation shaft of the developer support.

In another aspect of the present invention, a magnetic carrier is provided for use in a developing device or an image forming apparatus, wherein a volume-average particle size of the magnetic carrier is 20 μm or more to 60 μm or less.

In another aspect of the present invention, a toner is provided for use in a developing device or an image forming apparatus, wherein a volume-average particle size of the toner is 3 μm or more to 8 μm or less, and the volume-average particle size denoted by D1 and a number-average particle size denoted by D2 satisfy the following relationship:

$$1.00 \leqq D1/D2 \leqq 1.40.$$

In another aspect of the present invention, a toner is provided for use in a developing device or an image forming apparatus, wherein a shape factor SF-1 is within a range of 100 or more to 150 or less, and a shape factor SF-2 is within a range of 100 or more to 150 or less.

In another aspect of the present invention, a toner is provided for use in a developing device or an image forming apparatus, wherein in the toner, microparticles with an average primary particle size of 50 nm or more to 500 nm or less and a bulk density of 0.3 g/cm$^3$ or more are added externally to a surface of toner base particles.

BRIEF DESCRIPTION OF THE DRAWINGS

The above and other objects, features, and advantages of the present invention will become more apparent from the following detailed description taken with the accompanying drawings in which.

DESCRIPTION OF THE PREFERRED EMBODIMENTS

Before explaining the present invention, the prior art relating to the present invention and problems associated therewith will be described with reference to the appended drawings.

Figure 1:
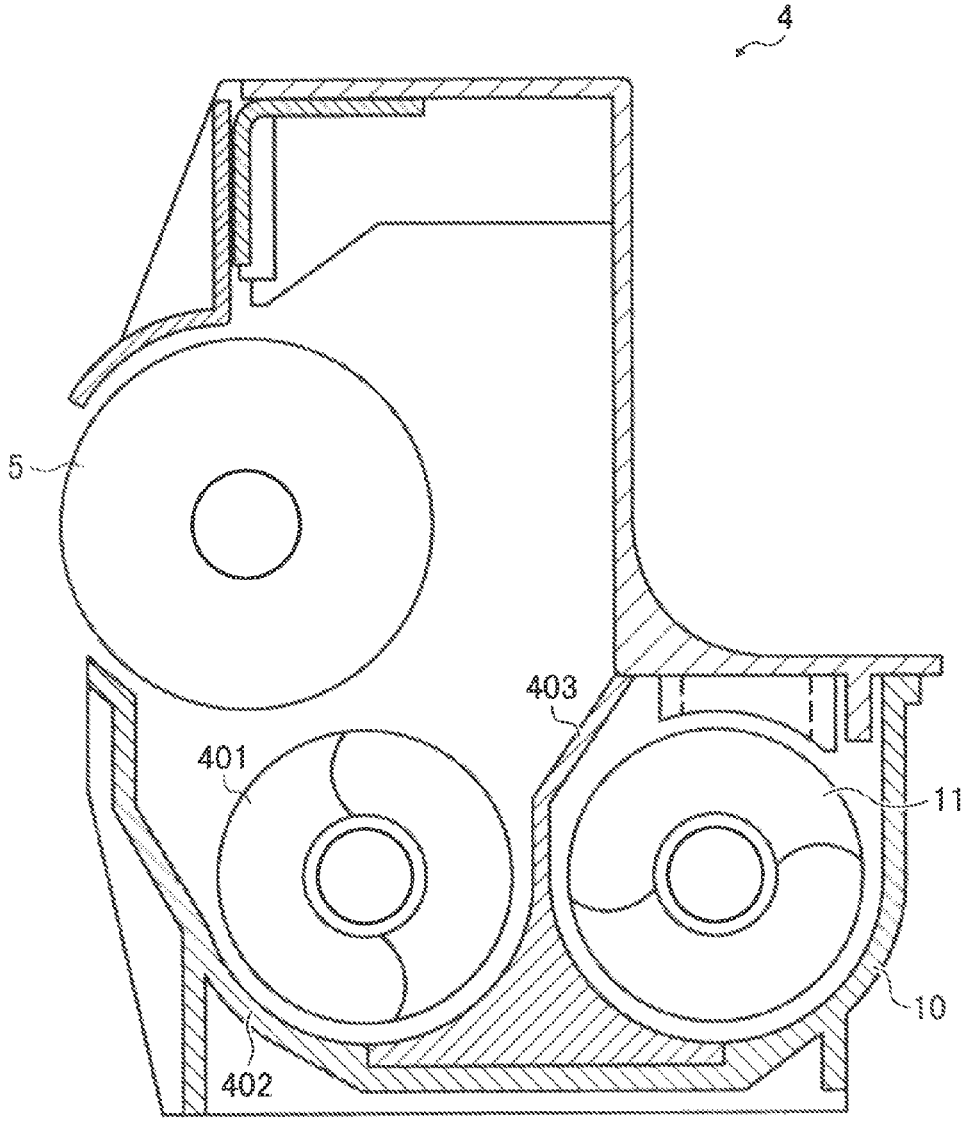
FIG. 1 PRIOR ART
FIG. 1 is an example of a schematic structural view of a known developing device.

A structure shown FIG. 1 is known as that of a developing device using a two-component developer comprising a toner and a magnetic carrier. In a developing device 4 shown in FIG. 1, a developer comprising a magnetic carrier and a toner is supported on the surface of a developing roller 5 that is a developer support with a plurality of magnetic poles provided inside the developing roller and conveyed to a zone facing a photosensitive body. A conveying path for feeding the developer to the developing roller 5 and a conveying path in which the developer is stirred are provided separate from each other, and the developer is circulated by conveying the developer in opposite directions in the two conveying paths.

In this developing device 4, the conveying path for feeding the developer to the developing roller 5 is made common with a conveying path for recovering the developer that was fed to the developing roller and has passed the development region. The resultant problem is that toner concentration in the developer that is fed to the developing roller 5 decreases toward the downstream side in the conveying direction of the conveying path for feeding the developer to the developing roller 5. The decrease in toner concentration in the developer fed to the developing roller 5 results in decreased image density during development.

This problem can be resolved by providing a screw for feeding the developer to the developing roller and a screw for recovering the developer after development in different developer conveying paths, as disclosed in Japanese Patent Applications Laid-open No. H11-167260 and 2001-290369. The developing devices disclosed in these open publications will be explained below.

Figure 2:
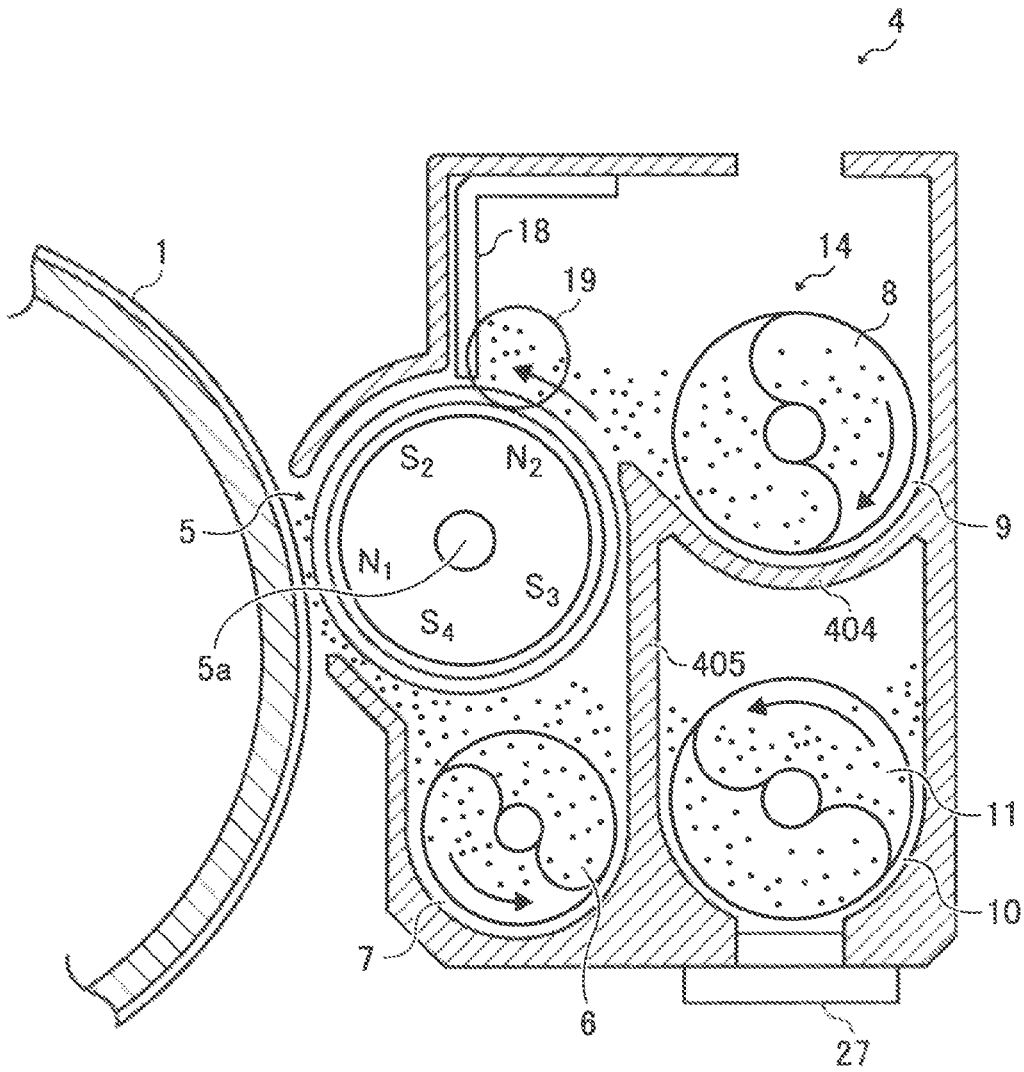
FIG. 2 PRIOR ART
FIG. 2 is a schematic structural view of a developing device disclosed in Japanese Patent Applications Laid-open No. H11-167260.

The developing device described in Japanese Patent Application Laid-open No. H11-167260 is shown in FIG. 2.

In a developing device 4 shown in FIG. 2, a feeding and conveying path 9 for feeding the developer to the developing roller 5 and a recovering and conveying path 7 in which the developer that has passed the development region is recovered are provided separate from each other. In addition, there is provided a stirring and conveying path 10 for conveying the developer in the direction opposite that of the feeding and conveying path 9, while stirring the developer conveyed to the downstreammost side of the feeding and conveying path 9 and the recovered developer conveyed to the downstreammost side of the recovering and conveying path 7.

In such developing device 4, the developer that has been used for development is conveyed to the recovering and conveying path 7 and, therefore, is not introduced into the feeding and conveying path 9. As a result, toner concentration in the developer located inside the feeding and conveying path 9 does not change and the toner concentration in the developer fed to the developing roller 5 remains constant. Furthermore, because the recovered developer is fed to the feeding and conveying path 9 after being stirred in the stirring and conveying path 10, without being fed to the feeding conveying path 9, the developer can be fed to the feeding and conveying path after sufficient stirring. As a result, it is possible to prevent non-uniform image density or decrease in image density during development that are caused by insufficient stirring and easily occur in developing devices which have no stirring and conveying path 10 and in which the developer conveyed to the stirring and conveying path 7 is immediately fed to the feeding and conveying path 9.

However, in this developing device 4, the feeding and conveying path 9 is disposed directly above the stirring and conveying path 10. Because the developer is transferred from the stirring and conveying path 10 to the feeding and conveying path 9 located directly thereabove, the developer is accumulated downstream of the stirring and conveying path 10, excess developer is fed, and the developer has to be raised by pushing with a stirring screw 11. Where the developer is fed vertically up under pressure, excess stress is applied to the developer and service life of the developer is shortened.

Figure 3:
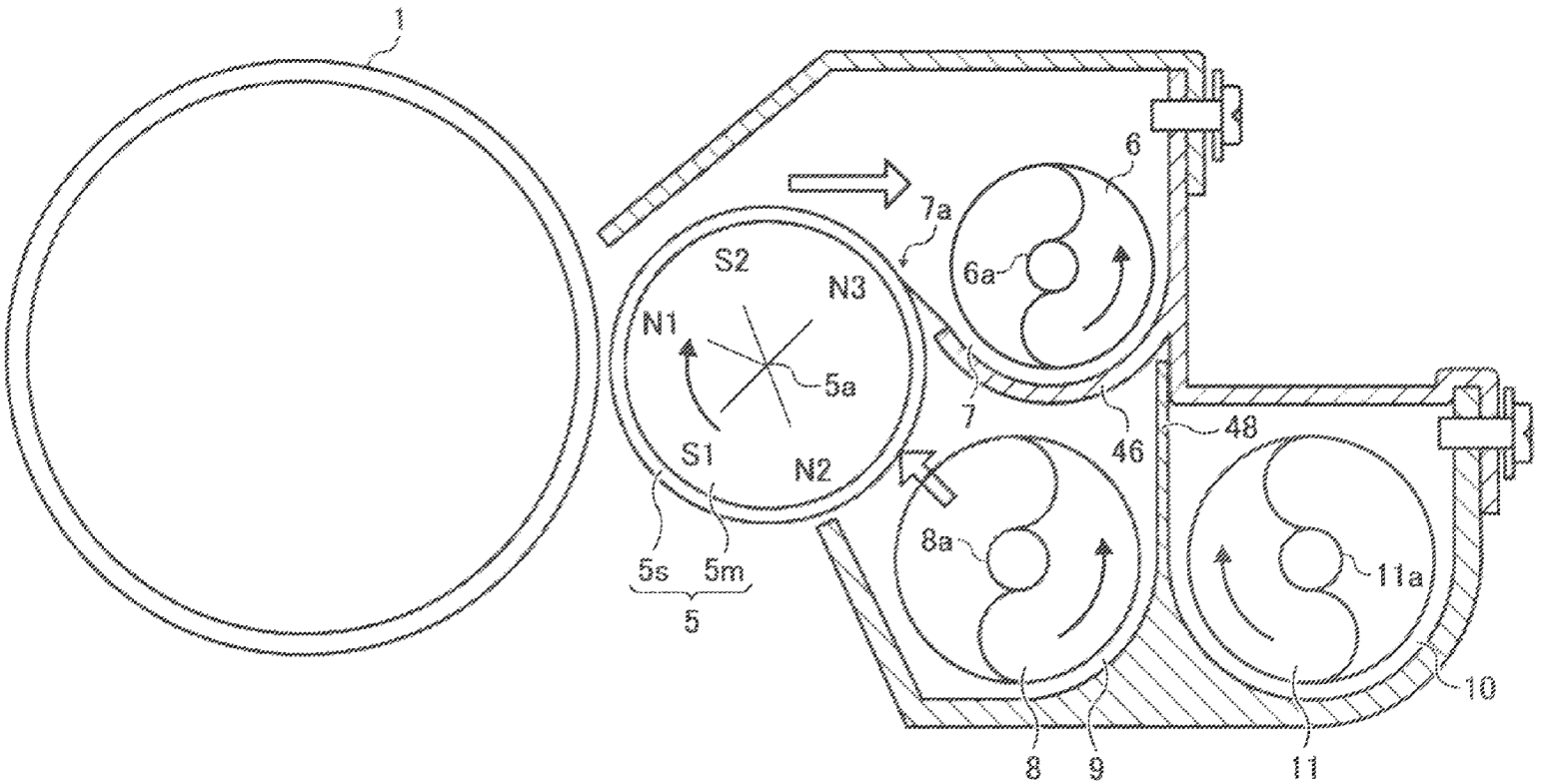
FIG. 3 PRIOR ART
FIG. 3 is a schematic structural view of a developing device disclosed in Japanese Patent Applications Laid-open No. 2001-290369.

The developing device described in Japanese Patent Application Laid-open No. 2001-290369 is shown in FIG. 3.

The developing device 4 shown in FIG. 3 comprises a recovering and conveying path 7 and a stirring and conveying path 10, and the operations of recovering and stirring a developer are performed separately in the recovering and conveying path 7 and the stirring and conveying path 10. As a result, it is possible to prevent the problems of decreased toner concentration or non-uniform toner concentration in the entire developer that are caused by feeding the developer that has not been stirred sufficiently to the feeding and conveying path 9, as in the Japanese Patent Application Laid-open No. H11-167260.

Furthermore, the feeding and conveying path 9 and stirring and conveying path 10 are disposed at almost the same height, and the recovering and conveying path 7 is disposed higher than the feeding and conveying path 9 and stirring and conveying path 10. The recovering and conveying path 7 is partitioned from the feeding and conveying path 9 with a recovery partition wall 46, an opening is provided in the recovery partition wall 46 at the downstream end in the conveying direction of the recovering and conveying path 7, and the downstream end in the conveying direction of the recovering and conveying path 7 and the downstream end in the conveying direction of the feeding and conveying path 9 are linked together. The developer fed to the recovering and conveying path 7 that is located above is a developer that is supported and raised upward by the developing roller 5. The developer that is brought to the downstream portion of the recovering and conveying path 7 by the recovery screw 6, which is a developer recovering and conveying member that conveys the developer located inside the recovering and conveying path 7, is fed to the upstream portion of the stirring and conveying path 10 by falling down from the opening of the recovery partition wall 46. On the other hand, the developer that reached the downstream portions of the stirring and conveying path 10 and feeding and conveying path 9 is fed to other upstream portions located at the same height.

Thus, the developer is not fed upward in a circulation system for the developer located inside the developer conveying paths, and shortening of the developer service life that is caused by stresses provided to a developer when the developer is fed upward can be inhibited.

However, in this developing device, the central position of the recovery rotary shaft 6*a* that is a rotary shaft of the recovery screw 6 is disposed so as to be higher than the central portion of a development rotary shaft 5*a* that is a rotary shaft of the developing roller 5. Where the central position of the recovery rotary shaft 6*a* is higher than the central position of the development rotary shaft 5*a*, the recovery screw 6 and recovering and conveying path 7 are also located higher than the developing roller 5. As a result, an on-roller developer recovery portion 7*a* that recovers the developer located on the developing roller 5 and feeds the recovered developer to the recovering and conveying path 7 is also disposed higher than the developing roller 5, and the inclination of the contact line of the surface of the developing roller 5 in the on-roller developer recovery portion 7*a* decreases. Where the inclination of the contact line of the surface of the developing roller 5 in the on-roller developer recovery portion 7*a* with respect to a horizontal plane is small, gravity hardly contributes to the recovery of the developer located on the developing roller 5. Further, part of the developer that was used for development remains on the surface of the developing roller 5 due to weakening of the supporting force created by magnetic forces in the on-roller developer recovery portion 7*a*. If the developer that was used for development remains on the surface of the developing roller 5, part of the developer that was used for development slips through a gap between the recovery partition wall 46 and surface of the developing roller 5 in the on-roller developer recovery portion 7*a* by the rotation of developing roller 5. The developer that slips through a gap between the recovery partition wall 46 and surface of the developing roller 5 enters the feeding and conveying path 9 located below the recovering and conveying path 9.

Where the developer that was used for development enters the feeding and conveying path 9, the problems inherent to the developing device 4 shown in FIG. 1 cannot be completely resolved, and toner concentration of the developer located inside the feeding and conveying path 9 can decrease locally. Where toner concentration of the developer located inside the feeding and conveying path 9 decreases locally, toner concentration in the developer on the developing roller 5 is uneven and image density becomes non-uniform.

In order to resolve the above-described problems inherent to prior art, in the developing device in accordance with the present invention, the developer recovering and conveying path is provided above the developer feeding and conveying path and developer stirring and conveying path. As a result, it is not necessary to raise the developer up when the developer is circulated and conveyed inside the developer conveying paths, application of excess stress to the developer can be prevented, and deterioration of the developer can be inhibited.

Further by using a configuration such that the central position of the rotary shaft of the developer recovering and conveying member is lower than the central position of the rotary shaft of the developer support, it is possible to lower the positions of the developer recovering and conveying member and the developer recovering and conveying path with respect to the developer support, as compared with those in the conventional developing device in which the central position of the rotary shaft of the developer recovering and conveying member is higher than the central position of the rotary shaft of the developer support. As a result, an on-support developer recovery portion that recovers the developer located on the developer support and feeds the recovered developer to the developer recovering and conveying path can be set to a position of the surface of the developer support that is lower than in the conventional developing device. Therefore the inclination of the contact line of the surface of the developer support in the on-support developer recovery portion with respect to a horizontal plane can be made larger than that in the conventional developing device. As a result, the component of gravity acting upon the developer in the on-support developer recovery portion that acts toward the rotary shaft of the developer support becomes less than that in the conventional device and the developer is easily separated from the surface of the developer support. Thus, the slipping of the developer through the on-support developer recovery portion in a state where the developer is supported on the surface of the developer support is inhibited and the recovery of the developer to the developer recovering and conveying path is enhanced, whereby the recovery ratio of the developer present on the surface of the developer support can be increased. By inhibiting the slipping of the developer through the on-support developer recovery portion in a state where the developer is supported on the surface of the developer support makes it possible to inhibit local decrease in toner concentration occurring when the developer that was used for development rotates together with the developer support and reaches the feed position.

The present invention will be described below in greater detail with reference to the appended drawings.

In the embodiment described hereinbelow, the present invention is applied to a printer serving as an image forming apparatus. This embodiment is explained with reference to a tandem-type image forming apparatus of the so-called intermediate transfer system, but the present invention is not limited to such an apparatus.

Figure 4:
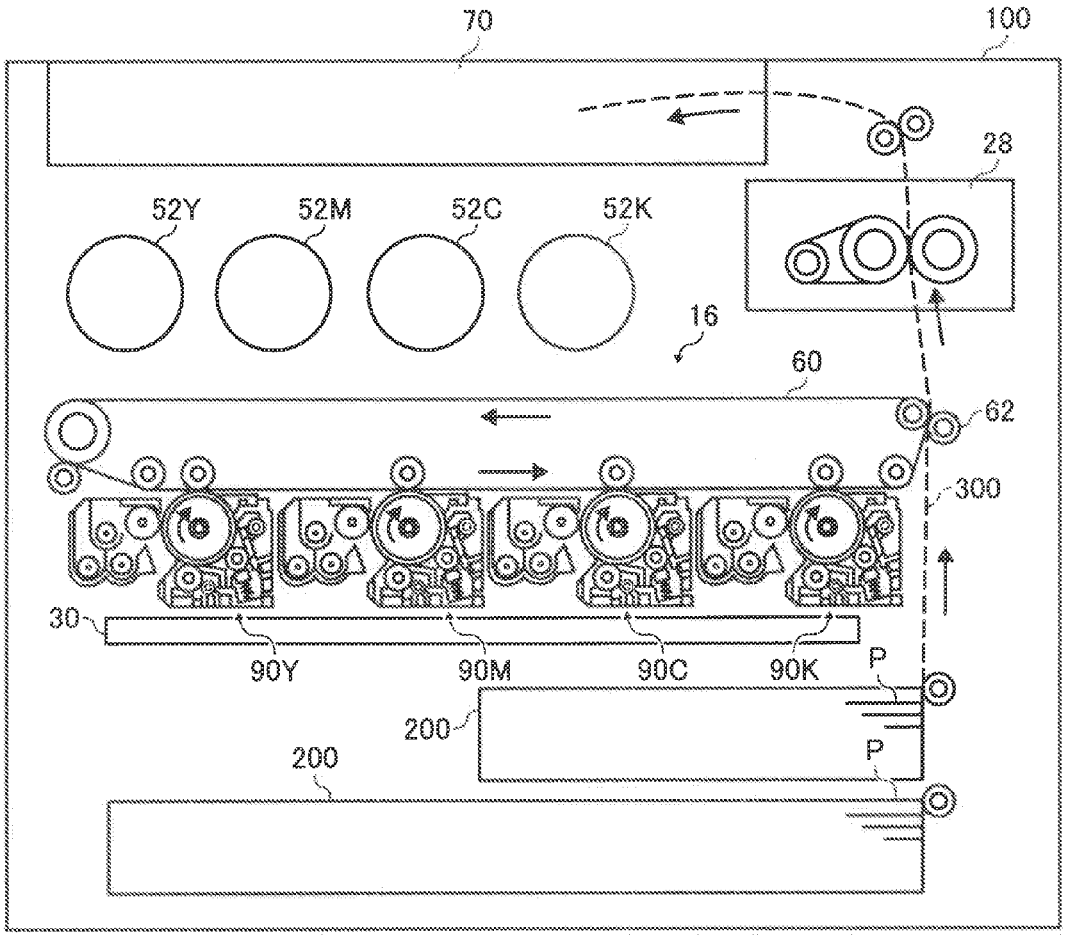
FIG. 4 is a schematic structural view of a printer relating to an embodiment of the present invention.

FIG. 4 shows a printer 100 of the present embodiment. The printer 100 comprises image forming units 90 (Y, M, C, K) for forming toner images of each color of yellow (Y), cyan (C), magenta (M), and black (K). A paper accommodation unit 200 that accommodates transfer paper P that is a recording body is provided below the image forming units 90 (Y, M, C, K). An intermediate transfer unit 16 comprising an intermediate transfer belt 60 that conveys a superposition of toner images of each color and a secondary transfer roller 62 that transfers the toner images located on the intermediate transfer belt 60 onto the transfer paper P is provided above the image forming units 90 (Y, M, C, K).

A fixing device 28 is provided above the secondary transfer unit where the intermediate transfer belt 60 and secondary transfer roller 62 face each other. The fixing device 28 comprises heating means that uses a belt or the like for fixing the unfixed toner present on the transfer paper P to the transfer paper P. A paper conveying path 300 by which paper is conveyed from a paper accommodation unit 200 to a paper discharge tray 70 via the secondary transfer unit and fixing device 28 is formed on the right side (as shown in the figure) of the intermediate transfer belt 60.

Toner bottles 52 (Y, M, C, K), which are toner accommodation containers that accommodate colored toners that have not yet been used, are installed above the intermediate transfer unit 16, and an exposure device 30 is installed between the intermediate transfer unit 16 and the paper accommodation unit 200. Furthermore, the printer 100 comprises an image processor or the like (not shown in the figures).

The structure of the image forming units 90 will be described below. Because the four image forming units 90 have identical structures, the only difference being in the color of the toner used, symbols Y, M, C, K indicating the color of the toner used in each image forming unit 90 will be hereinbelow omitted.

Figure 5:
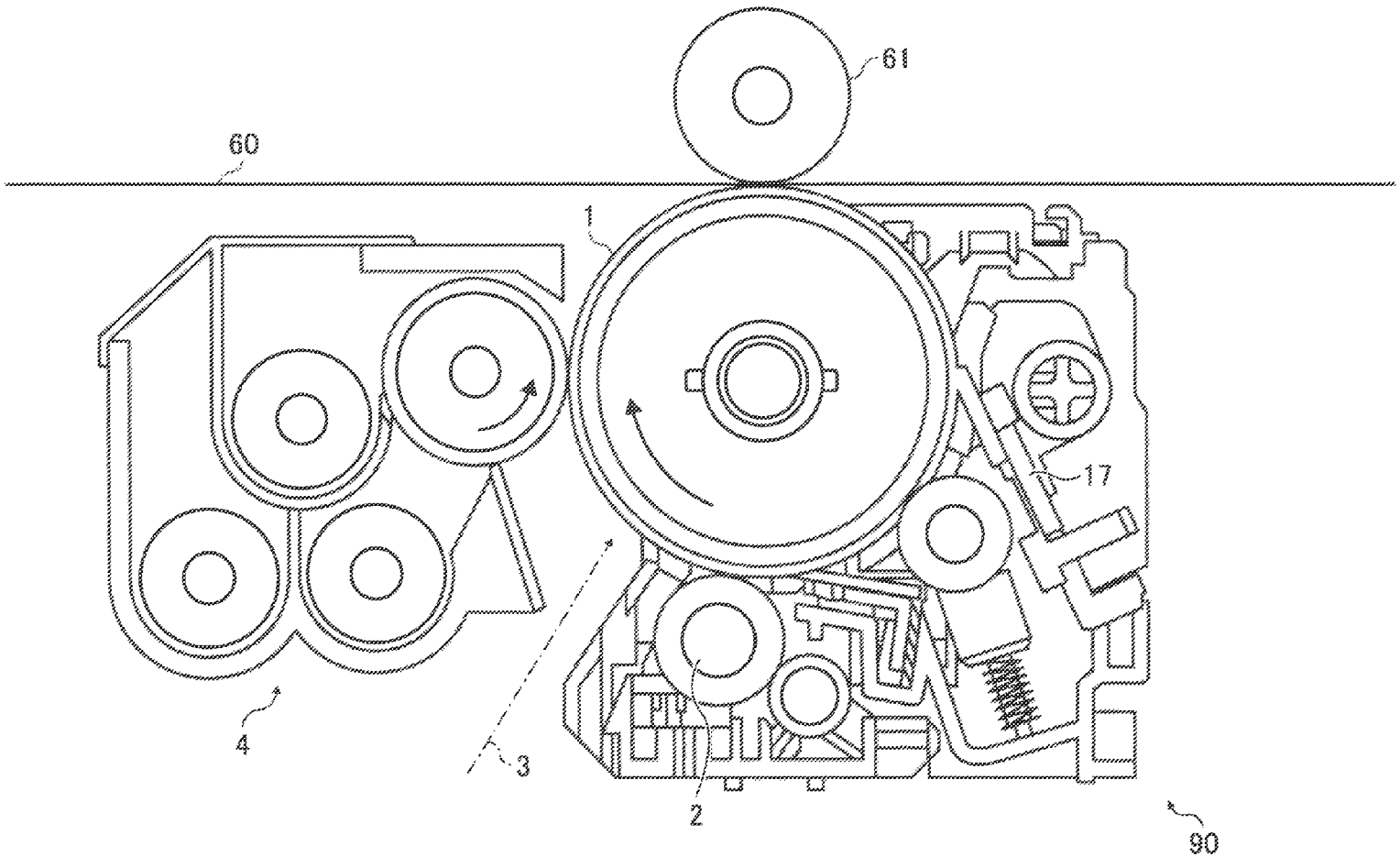
FIG. 5 shows schematically an image forming unit of the printer.

As shown in FIG. 5, the image forming unit 90 comprises as the main components a photosensitive body 1 that is a latent image support, a charging device 2 such as a charging roller, a development device 4, which is development means, and a cleaning device 17 that uses a blade or the like to remove the toner remaining after transferring from the photosensitive body 1.

The operation of the printer 100 will be explained below.

Where an image output command is sent to the printer 100 from an input device such as a PC or scanner (not shown in the figures), an image signal is image processed and divided into signals of each color of Y, M, C, K in an image processing unit and then sent to the exposure device 30. The exposure device 30 employs an exposure system, for example, of a laser scan type that uses a laser beam source and a polygonal mirror.

In the image forming unit 90 of each color, the photosensitive body 1 is driven and the photosensitive body 1 is uniformly charged by the charging device 2. The, photosensitive body is thereafter irradiated with a laser beam 3 corresponding to the image signal from the exposure device 30, and an electrostatic latent image is formed on the photosensitive body 1. The electrostatic latent image present on the surface of the photosensitive body 1 is converted into a visible image serving as a toner image by developing in a development unit in which the photosensitive body 1 and a development device 4 face each other. The toner image located on the surface of the photosensitive body 1 is primary transferred onto the intermediate transfer belt 60 by applying bias to the primary transfer roller 61. The non-transferred toner remaining on the photosensitive body 1 after the primary transfer is removed by a blade of the cleaning device 17 and the surface of the photosensitive body 1 is cleaned, and then charging for the next image forming cycle is performed. The printer operation is performed in the above-described cycles. The toner consumed by development is replenished by using a toner replenishment device 50 that is toner replenishment means for replenishing toners from toner bottles 52 to the development devices 4.

On the other hand, transfer of toner images onto the intermediate transfer belt 60 is successively performed from the image forming units 90 (Y, M, C, K) of all colors, and color toner images are superimposed on the intermediate transfer belt 60. The transfer paper P passes from the paper accommodation unit 200 via the paper conveying path 300, and a toner image is transferred in a secondary transfer unit in which the intermediate transfer belt 60 and the secondary transfer roller 62 face each other. The transfer paper P carrying the unfixed toner image advances into the fixing device 28, where the toner is melted and fixed to the transfer paper P by heat and pressure. The image forming process is completed by outputting the paper onto a paper discharge tray 70 located outside the image forming device.

The development device 4 that includes a specific feature of the present invention will be described below.

Figure 6:
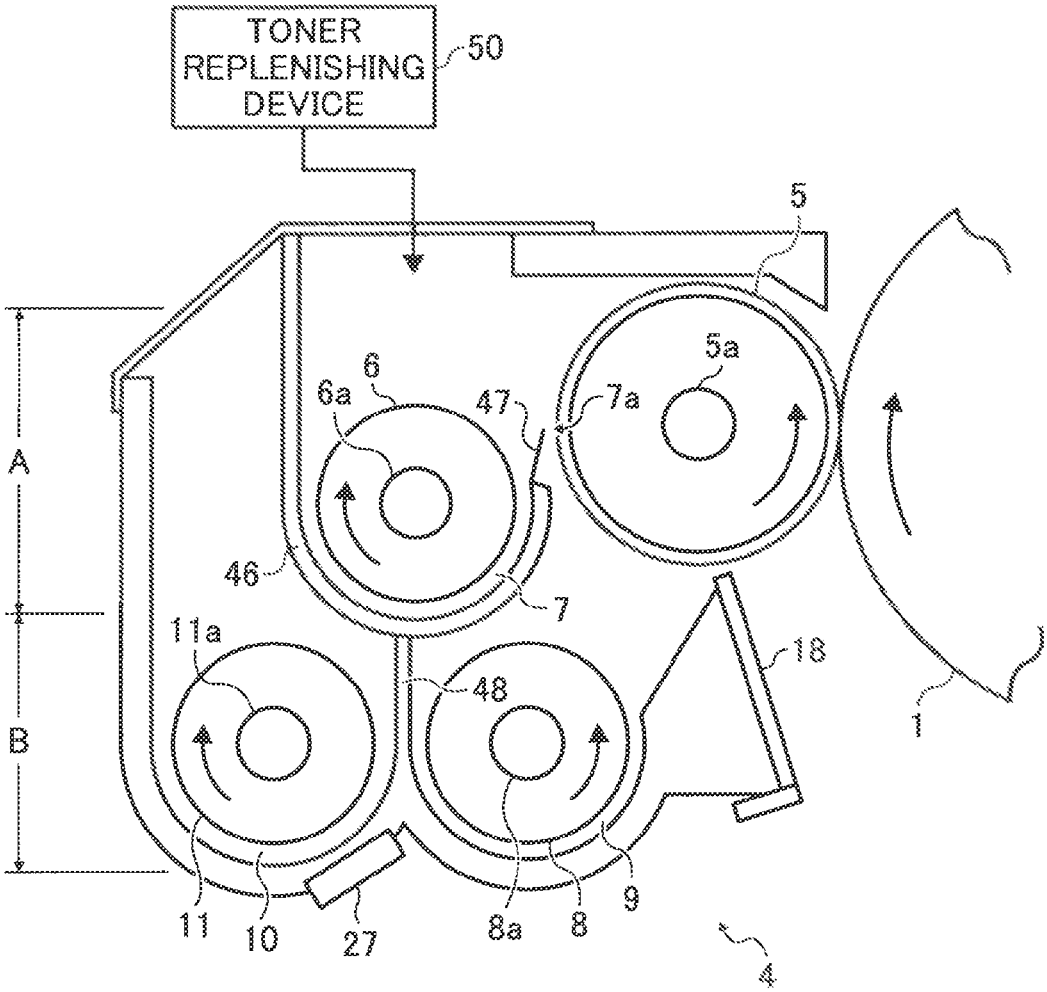
FIG. 6 is a schematic structural view of a developing device of the printer.

As shown in FIG. 6, the development device 4 comprises a development roller 5 serving as a developer support, a developer conveying member that causes circulation of the developer inside the development device 4, a doctor blade 18 as a developer layer thickness regulating member, and a toner concentration sensor 27. The developer conveying member has a screw-like shape comprising a spiral blade on a rotary shaft and conveys the developer in the axial direction of the rotary shaft by rotating the rotary shaft about the center thereof. Three such developer conveying members are provided.

The first developer conveying member is a feed screw 8 serving as a developer feeding and conveying member that is disposed lower than the developing roller 5 and to the left thereof, as shown in FIG. 6, conveys the developer along the axial line direction of the developing roller 5, and feeds the developer to the developing roller 5. The second developer conveying member is disposed to the left of the developing roller 5 shown in FIG. 6. The second developer conveying member is a recovery screw 6 serving as a developer recovering and conveying member that conveys the developer that is recovered from the surface of the developing roller 5 after passing through a zone facing the photosensitive body 1 along the axial line direction of the developing roller 5 and in the same direction as the feed screw 8. The third developer conveying member is disposed to the left of the feed screw 8 shown in FIG. 6. The third developer conveying member receives the feed of the excess developer that is conveyed to the downstreammost side in the conveying direction of the feed screw 8, without being fed to the developing roller 5, and the recovered developer that is recovered from the developing roller 5 and conveyed to the downstreammost side in the conveying direction of the recovery screw 6. This third developer conveying member is a stirring screw 11 serving as a developer stirring and conveying member that conveys the excess developer and recovered developer along the axial line direction of the developing roller 5 and in the direction opposite that of the feed screw 8, while stirring the two developers, and feeds the developer to the upstreammost side in the conveying direction of the feed screw 8.

Spaces where the three developer conveying members are disposed are partitioned with a casing. The space comprising the recovery screw 6 is partitioned with a recovery partition wall 46 from the spaces comprising the feed screw 8 and stirring screw 11, thereby forming a recovering and conveying path 7 serving as a developer recovering and conveying path. The space comprising the feed screw 8 and the space comprising the stirring screw 11 are partitioned by a stirring-feeding partition wall 48, thereby forming a feeding and conveying path 9 serving as a developer feeding and conveying path and a stirring and conveying path 10 serving as a developer stirring and conveying path.

The stirring-feeding partition wall 48 comprises openings at both ends in the axial directions of the feed screw 8 and stirring screw 11, those openings linking the feeding and conveying path 9 and stirring and conveying path 10 and enabling the circulation of the developer. The zones outside the openings are partitioned by the stirring-feeding partition wall 48, and the developer does not move therein between the feeding and conveying path 9 and stirring and conveying path 10. Further, an opening is also provided in the lower surface of the recovery partition wall 46 at the downstream end in the developer conveying direction of the recovery screw 6, and the developer that is conveyed to the downstream end of the recovering and conveying path 7 is fed to the upstream end of the stirring and conveying path 10. Similarly to the stirring-feeding partition wall 48, in the zones of the recovery partition wall 46 outside the opening, the developer does not move from the recovering and conveying path 7 to other two developer conveying paths.

Further, as shown in FIG. 6, the recovery partition wall 46 does not come into contact with the casing of the development device 4 above the recovery screw 6, and an opening linking the recovering and conveying path 7 to the space where the developing roller 5 is disposed is formed between the upper end of the recovery partition wall 46 and the casing. The developer that has passed through the development region on the developing roller 5 moves from the opening located above the recovery partition wall 46 into the recovering and conveying path 7. Further, a partition wall upper end member 47 is provided at the upper end of the recovery partition wall 46 on the side of the developing roller 5. The recovered developer that passed through the development region and is located on the developing roller 5 moves from above the partition wall upper end member 47 at the upper end portion of the recovery partition wall 46 into the recovering and conveying path 7.

As shown in FIG. 6, the central position of a stirring rotary shaft 11*a* that is a rotary shaft of the stirring screw 11 and the central position of a feed rotary shaft 8*a* that is a rotary shaft of the feed screw 8 are arranged to be at almost the same height. Thus, the stirring screw 11 and stirring and conveying path 10, and the feed screw 8 and feeding and conveying path 9 are almost at the same height. Further, the central position of the recovery rotary shaft 6*a* that is a rotary shaft of the recovery screw 6 is arranged to be higher than the central positions of the stirring rotary shaft 11*a* and feed rotary shaft 8*a*. As a result, it is not necessary to raise the developer up when the developer is circulation conveyed inside the developer conveying paths, application of excess stress to the developer can be prevented, and stress applied to the developer can be reduced.

Further, the central position of the recovery rotary shaft 6*a* is arranged to be lower than the central position of the development rotary shaft 5*a* that is a rotary shaft of the developing roller 5. The positions of the recovery screw 6 and recovering and conveying path 7 with respect to the developing roller 5 can thus be lowered. As a result, it is possible to dispose the distal end of the partition wall upper end member 47 opposite the developing roller 5 and set an on-roller developer recovery portion 7*a* that recovers the developer located on the developing roller 5 and feeds the recovered developer to the recovering and conveying path 7 in a position below the surface of the developing roller 5. Further, the inclination of the contact line of the surface of the developing roller 5 in the on-roller developer recovery portion 7*a* with respect to a horizontal plane can be increased. As a result, the component of gravity acting upon the developer in the on-roller developer recovery portion 7*a* that acts toward the development rotary shaft 5*a* of the developing roller 5 is decreased with respect to that of the conventional devices, and the developer can be easily separated from the surface of the developing roller 5. Thus, slipping through the on-roller developer recovery portion 7*a* in a state where the developer is supported on the surface of the developing roller 5 is inhibited and the recovery to the recovering and conveying path 7 is enhanced, whereby the recovery ratio of the developer present on the surface of the developing roller 5 can be increased. By inhibiting the slipping through the on-roller developer recovery portion 7*a* in a state where the developer is supported on the surface of the developing roller 5 makes it possible to prevent local decrease in toner concentration occurring when the developer that was used for development rotates together with the developing roller 5 and reaches the feed position.

Figure 7:
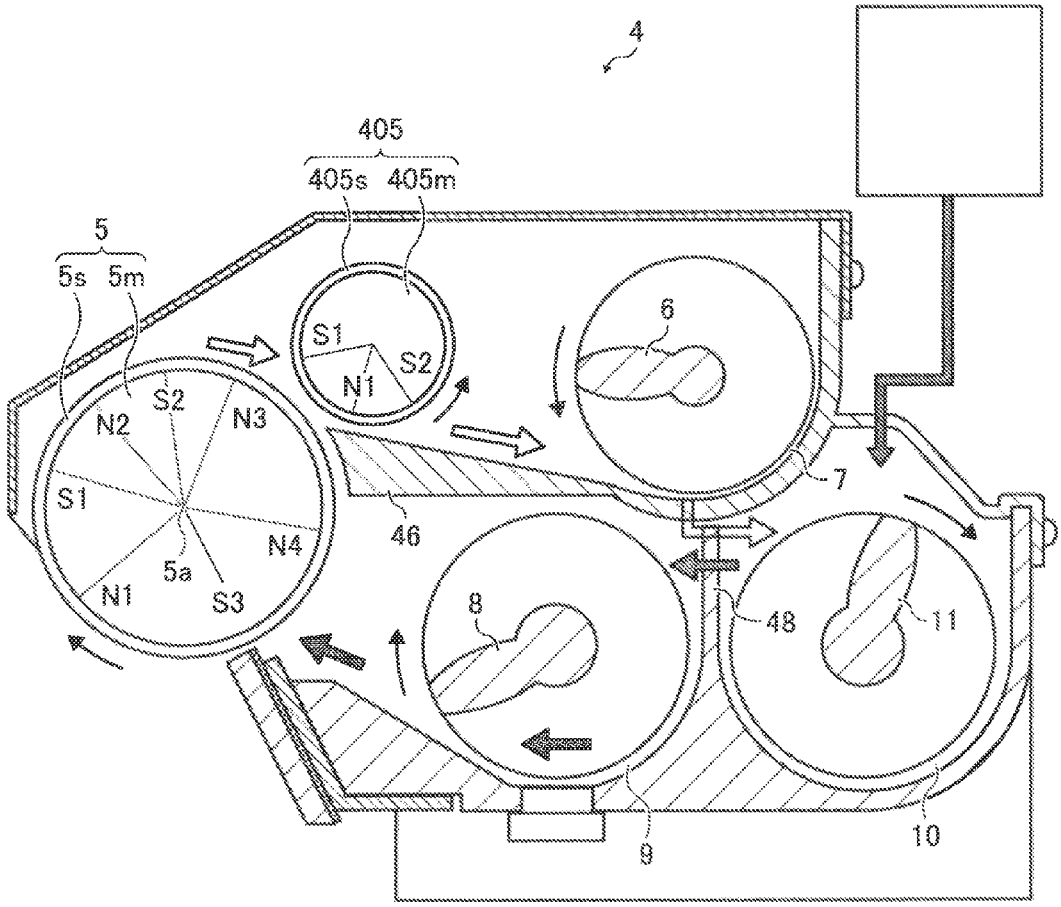
FIG. 7 PRIOR ART
FIG. 7 is a schematic structural view of a conventional developing device that comprises a magnetic roller and has increased recovery ratio of a developer on the developing roller surface.

The aforementioned Japanese Patent Application Laid-open No. 2003-263025 describes the developing device 4 in which the recovering and conveying path 7 is provided above the feeding and conveying path 9 and stirring and conveying path 10 as a configuration that increases the recovery ratio of the developer located on the surface of the developing roller 5. This developing device is shown in FIG. 7. In the developing device 4, the size of the developing device is increased due to the addition of parts such as a magnetic roller 405, the freedom of design layout is reduced, in particular in applications to color image forming devices, and, as a result, the device scale is increased. On the other hand, with the developing device 4 of the present embodiment that is shown in FIG. 6, the recovery ratio of the developer located on the surface of the developing roller 5 can be increased without adding a new part.

Further, the distal end of the partition wall upper end member 47 provided in the upper end portion of the recovery partition wall 46 is preferably set below the central position of the development rotary shaft 5*a* of the developing roller 5. As a result, the inclination of the contact line of the surface of the developing roller 5 in the on-roller developer recovery portion 7*a* is made more than 90°, and the surface of the developing roller 5 assumes a state in which it does not support the developer from below. Therefore, gravity can easier contribute to the separation of the developer from the surface of the developing roller 5, and the recovery ratio of the developer located on the surface of the developing roller 5 can be increased.

The outer diameter of the developing roller 5 of the present embodiment is 18 mm, the outer diameter of each screw that is a developer conveying member is 15 mm, and the shaft diameter is 5 mm. The pitch width of each screw is 25 mm. These values place no limitation on the present invention.

In the developing device 4, the recovering and conveying path 7 is provided above the stirring-feeding partition wall 48 that partitions the feeding and conveying path 9 and stirring and conveying path 10 that have almost the same height, and the recovering and conveying path 7 is contained within a combined width of the feeding and conveying path 9 and stirring and conveying path 10. As a result, the developing device 4 can be miniaturized.

The arrangement of magnetic poles in the developing roller 5 will be explained below.

Figure 8:
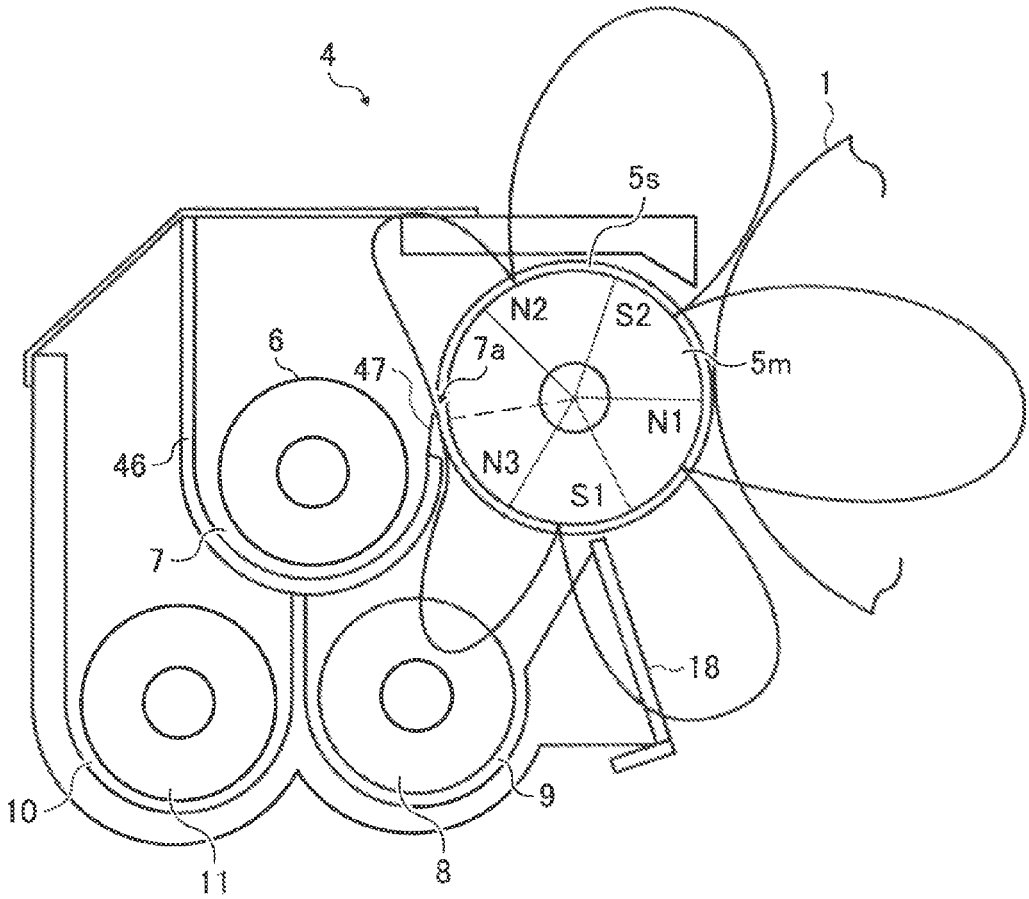
FIG. 8 shows a magnetic pole arrangement in a developing roller of the printer.

As shown in FIG. 8, the developing roller 5 mainly comprises a magnet roller 5*m* comprising a plurality of magnetic poles that are magnetic field generating means and fixed inside and a development sleeve 5*s* that can rotate on the outside of the magnetic roller. Magnetic fields are generated around the development sleeve 5*s* by the magnetic poles (N1, S2, N2, N3, S1) of the magnet roller 5*m* that is fixed inside. Normal components of magnetic flux density on the surface of the development sleeve 5*s* are shown in FIG. 8.

The developer that is scooped up from the feeding and conveying path 9 to the developing roller 5 by the magnetic pole N3 located inside the developing roller 5 is converted into a thin layer with the doctor blade 18 and conveyed into the development region (position of the development magnetic pole N1) in the proximity of the photosensitive body 1. The recovered developer that passed through the development region is separated from the surface of the developing roller 5 by the repulsion magnetic poles N2 and N3 and falls down into the recovering and conveying path 7.

In FIG. 8, a value of normal component of magnetic flux density on the surface of the development sleeve 5*s* in a position (dot line) close to the on-roller developer recovery portion 7*a* where the partition wall upper end member 47 and the developing roller 5 face each other is 10 mT or less. Where the value of 10 mT is exceeded, there is a risk that the developer that has once separated from the surface of the developing roller 5 will again adhere to the developing roller 5 and advance toward the feeding and conveying path 9.

By making the normal magnetic force on the surface of developing roller 5 in the vicinity of the on-roller developer recovery portion 7*a* of 10 mT or less, it is possible to ensure reliable separation of developer from the developing roller 5 to the recovering and conveying path 7. Further, the recovered developer is prevented from being pulled back into the feed unit by magnetic forces, and stability of image density can be maintained.

Adjustment by magnetic pole arrangement in the magnet roller 5*m* is used to obtain a value of 10 mT or less for a normal component of magnetic pole density on the surface of the development sleeve 5*s* in a position close to the on-roller developer recovery portion 7*a*. Further, a shielding member that does not transmit magnetic forces may be provided in the vicinity of the on-roller developer recovery portion 7*a*.

Figure 9:
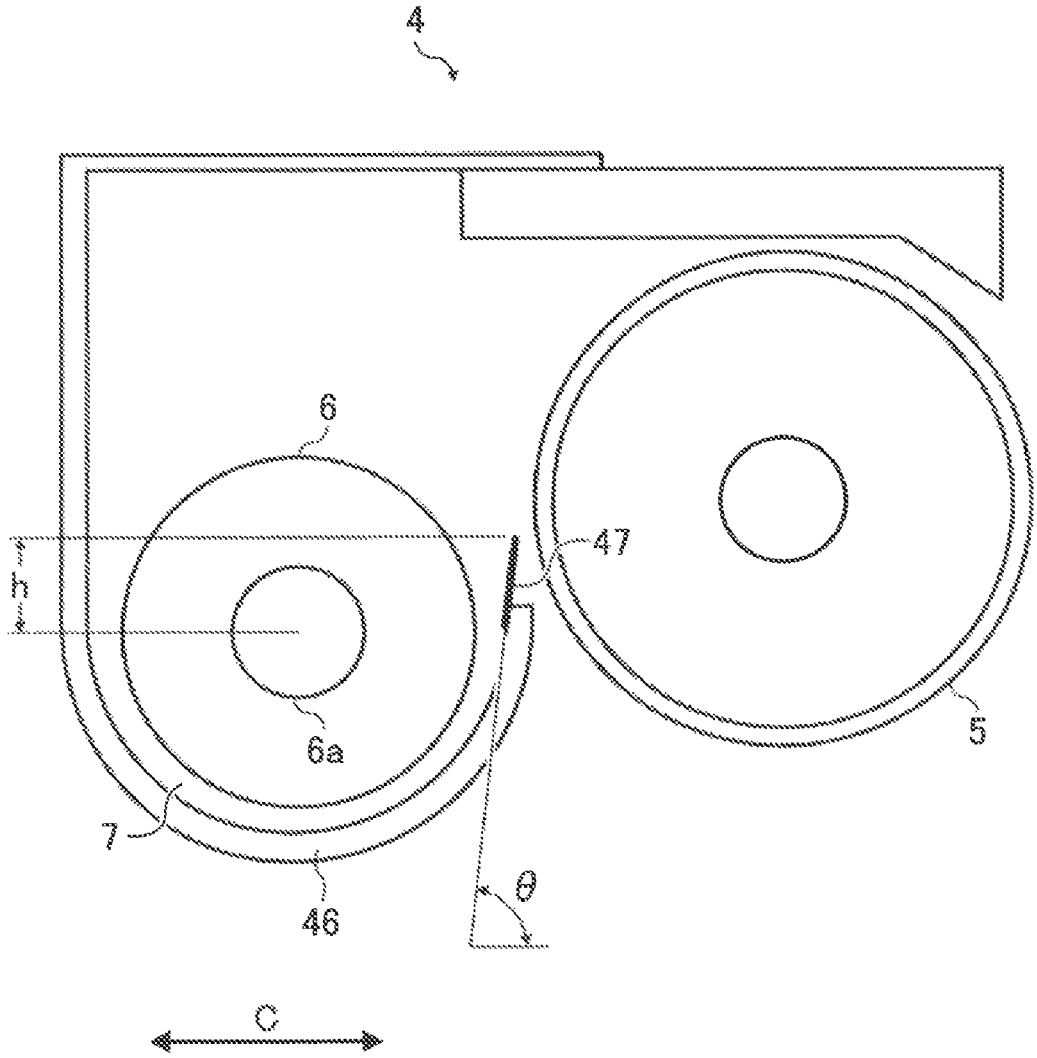
FIG. 9 is a schematic structural view of the developing device.

FIG. 9 shows a schematic configuration of the upper portion A of the developing device 4 shown in FIG. 6.

As shown in FIG. 9, the upper end of the partition wall upper end member 47 is arranged in a position that is by h higher than the central position of the recovery rotary shaft 6*a* of the recovery screw 6.

In the recovering and conveying path 7, the developer is conveyed, while the recovered developer is received from the developing roller 5 over the entire zone in the conveying direction. Therefore, the amount of developer contained per predetermined length in the axial direction increases toward the downstream side in the conveying direction. At the downstream side of the recovering and conveying path 7, the amount of the contained developer, the size of the recovery screw 6, and the revolution speed of the recovery screw 6 are set so that the level of developer is below the upper end of the partition wall upper end member 47. The smaller is the amount of the contained developer, the harder it is for the developer to overflow. The higher is the revolution speed of the recovery screw 6, the shorter is the time in which the developer is present in the recovering and conveying path 7. Accordingly, the amount of developer contained in other developer conveying paths increases and the amount of developer contained in the recovering and conveying path 7 is decreased, thereby making it difficult for the developer to overflow. However, a high revolution speed of the recovery screw 6 increases stresses applied to the developer and results in developer deterioration. Further, the larger is the diameter of the recovery screw 6, the larger is the capacity of the recovering and conveying path 7 that contains the recovery screw, and the developer can be prevented from overflowing even if the upper end of the partition wall upper end member 47 is located in a position lower than that of the recovery screw 6.

Even with the configuration that prevents the overflowing of developer conveyed in the recovering and conveying path 7, if the bulk of developer at the downstream end of the recovering and conveying path 7 is below the central position of the recovery rotary shaft 6*a* of the recovery screw 6, a large useless space is created inside the developing device 4. More specifically, the length in the width direction (direction of arrow C in FIG. 9) of the recovery screw 6 reaches maximum in the central position of the recovery rotary shaft 6*a*. A state in which the bulk of developer only reaches a location below the central position of the recovery rotary shaft 6*a* in which the length in the width direction becomes maximum is a state in which useless space is large in both the width direction and the height direction of the recovering and conveying path 7. In order to use effectively the width of the recovering and conveying path 7, it is desirable that the developer bulk in the downstreammost zone of the recovering and conveying path 7 be set higher than at least the central position of the recovery rotary shaft 6*a*. Further, with the configuration in which the developer bulk in the downstreammost zone of the recovering and conveying path 7 is higher than the central position of the recovery rotary shaft 6*a*, the upper end of the partition wall upper end member 47 has to be in a position higher than the central position of the recovery rotary shaft 6*a* of the recovery screw 6 in order to prevent the developer from overflowing from the recovering and conveying path 7.

Further, as the h in FIG. 9 increases, it becomes more difficult for the developer to overflow from the recovering and conveying path 7. As a result, it is possible to retain a certain amount of the developer that is separated from the surface of the developing roller 5 and increases in quantity downstream of the recovery and conveying portion, without returning the developer to the feed portion. Therefore, margin of preventing the return of developer to the feed portion can be increased even when conveying efficiency degrades due variation of developer properties.

An angle θ between the partition wall upper end member 47 provided at the upper end of the recovery partition wall 46 on the side of the developing roller 5 and a horizontal plane of the surface facing the recovery screw 6 is set to 60° or more.

Figure 10:
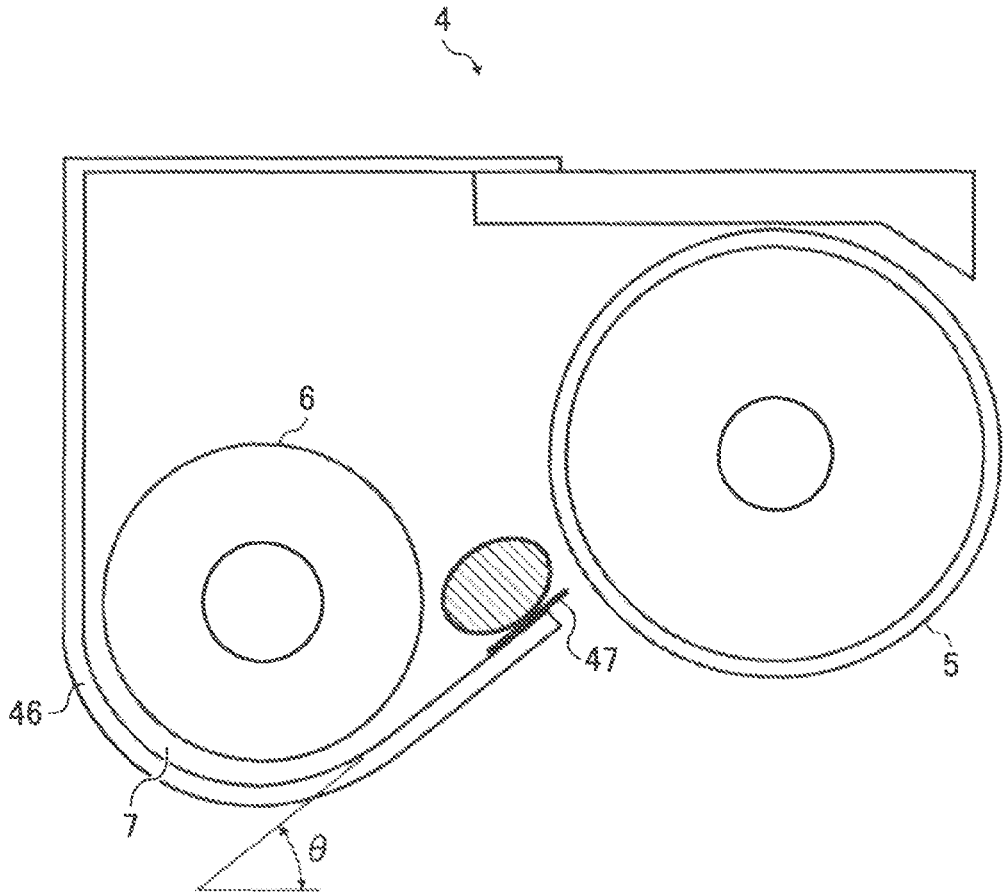
FIG. 10 illustrates a state with a small angle between an upper end member of a partition wall located in the upper portion of the developing device and a horizontal surface facing the recovery screw.

FIG. 10 shows a state in which the angle θ between the partition wall upper end member 47 and a horizontal plane of the surface facing the recovery screw 6 is less than 60°. As shown in FIG. 10, where the angle θ is small, the recovered developer accumulates in the space shown by hatching in FIG. 10 and the developer does not fall down into the recovering and conveying path 7. At the same time, the developer easily falls down from the distal end side of the partition wall upper end member 47 and returns to the feeding and conveying path 9 located therebelow. The return of developer into the feeding and conveying path 9 is undesirable because it causes decrease in toner concentration.

On the other hand, as shown in FIG. 9, where angle θ is 60° or more, the recovered developer that is separated from the developing roller 5 falling down into the recovering and conveying path 7 within a shorted interval. As a result, the amount of the recovered developer that remains on the recovery partition wall 46, which is the recovery casing, and is not supplied to the recovery screw 6 can be reduced. The recovery efficiency of the recovered developer is thus increased, the developer can be prevented from returning to the feeding and conveying path, and long-term stability of toner concentration can be maintained.

Further, it is desirable that the surface of the developing roller 5 does not come into contact with the distal end of the partition wall upper end member 47 provided at the upper end of the recovery partition wall 46 on the side of the developing roller 5 and that a predetermined gap be maintained therebetween. In the developing device 4 of the present embodiment, the partition wall upper end member 47 is a thin phosphorus bronze plate attached to the upper end of the recovery partition wall 46 on the side of the developing roller 5 so that the gap between the partition wall upper end member and the developing roller 5 is 1 mm. It is desirable that the gap between the developing roller 5 and the partition wall upper end member 47 be 0.5 to 1.5 mm.

When the partition wall upper end member 47 is disposed so as to be brought into contact with the developing roller 5 by using a member from Mylar or the like, the recovered developer can be initially prevented from returning to the feeding and conveying path 9. However, in continuous operation, the toner penetrates into zones where friction occurs between the Mylar and the developing roller 5 and is fused therein, causing such problems as developer aggregation or toner fixation to the surface of the developer sleeve 5*s*. On the other hand, when there is no contact between the distal end of the partition wall upper end member 47 and the surface of the developing roller 5 and a predetermined gap is maintained therebetween, the problems of developer aggregation or toner fixation to the surface of the developer sleeve 5*s* can be prevented.

The rotation direction of the recovery screw 6 will be explained below.

Figure 11:
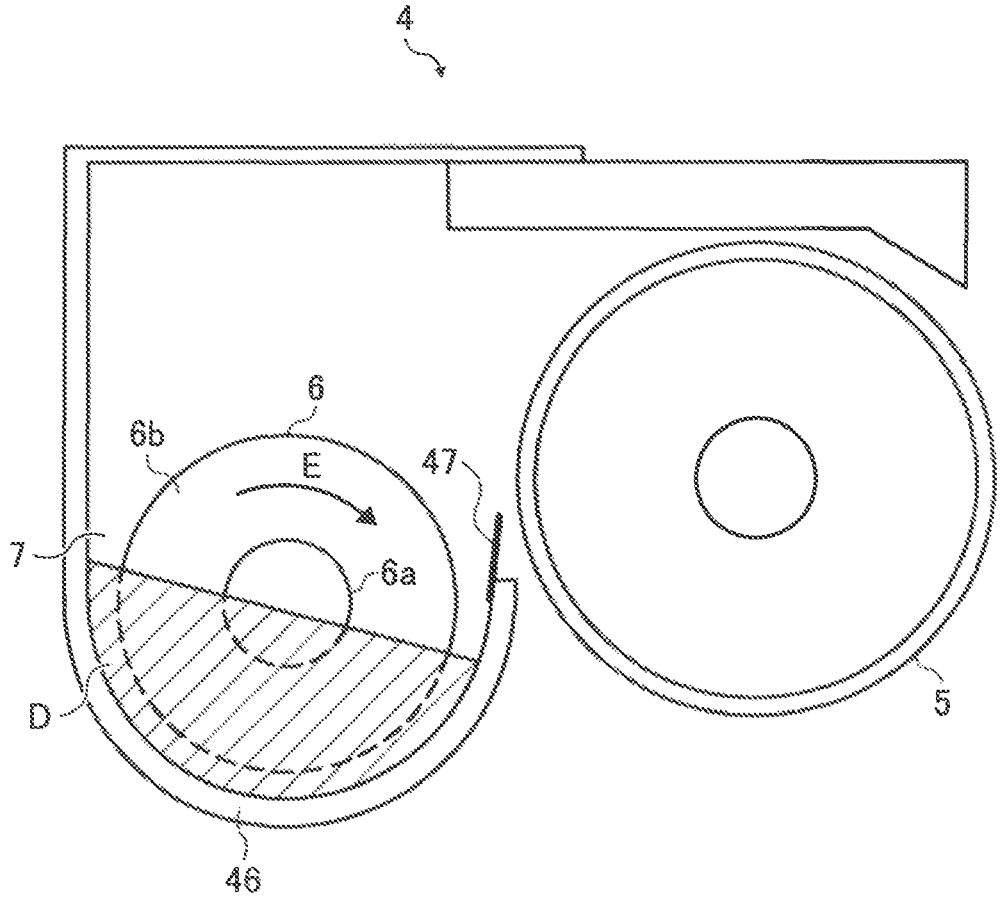
FIG. 11 is an explanatory drawing illustrating the rotation direction of the recovery screw and deviation of a developer located in the recovering and conveying path.

FIG. 11 shows the rotation direction of the recovery screw 6 and deviation of developer inside the recovering and conveying path 7. The recovery screw 6 has a shape in which a recovery blade 6*b* that is a spiral blade is provided on the recovery rotary shaft 6*a*.

As shown in FIG. 11, the recovery blade 6*b* on the side of the developing roller 5 (right side in FIG. 11) rotates so as to move from above the recovery rotary shaft 6*a* to below this shaft, and the blade on the opposite side from the developing roller 5 (left side in FIG. 11) rotates so as to move from below the recovery rotary shaft 6*a* to above this shaft. Thus, it is desired that the blade rotate in the direction of arrow E in FIG. 11.

Figure 12:
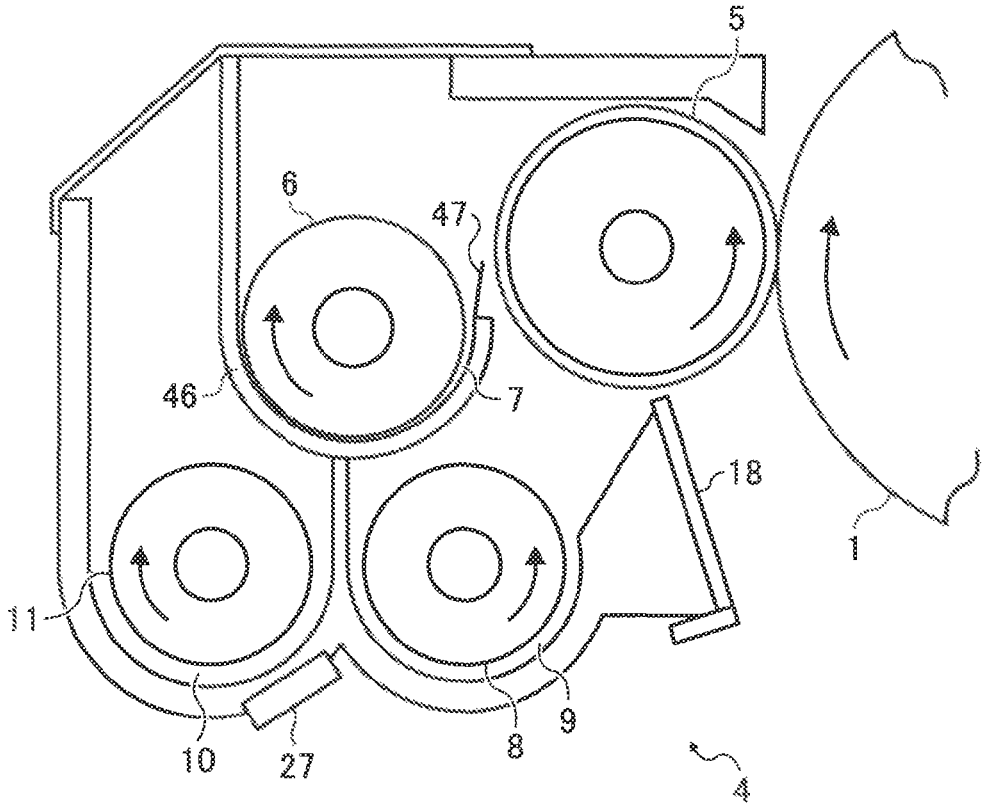
FIG. 12 is a schematic structural view of the developing device in which the outer diameter of the recovery screw is set larger than the outer diameter of other two screws.

As a result, as shown in FIG. 12, the developer D located in the recovering and conveying path 7 is conveyed, while being accumulated, in the direction from the developing roller 5. Therefore, a configuration is obtained, in which return of the recovered developer into the feeding and conveying path 9 is made difficult. As a result, even if the amount of developer contained in the recovering and conveying path 7 is large, the developer is prevented from overflowing, as compared with the configuration in which the recovery screw 6 rotates in the opposite direction, and stability of toner concentration can be maintained. Further, at a low revolution speed of the recovery screw 6, stresses applied to the developer can be reduced, but if the revolution speed is low, the conveying speed is low and the amount of developer inside the recovering and conveying path 7 increases. By contrast, where the recovery screw 6 rotates in the direction such as shown in FIG. 12, the developer can be prevented from overflowing even when the revolution speed of the recovery screw 6 is low and a large amount of developer is present in the recovering and conveying path 7.

Further, by making the outer diameter of the recovery screw 6 larger than the outer diameters of the stirring screw 11 and feed screw 8, the recovered developer can be more effectively prevented from returning to the feeding and conveying path 9.

FIG. 12 shows a schematic configuration of the developing device 4 in which the outer diameter of the recovery screw 6 is made larger than the outer diameters of the stirring screw 11 and feed screw 8. As shown in FIG. 12, because a comparatively open space in the upper part of the developing device 4 is used for the recovering and conveying path 7, a screw with a large outer diameter can be disposed as the recovery screw 6. As a result, conveying efficiency in the recovering and conveying path 7 is increased, whereby stagnation of the developer in the downstream zone in the conveying direction of the recovering and conveying path 7 is reduced and a contribution is made to preventing the developer from returning to the feeding and conveying path 9. The reduction of the revolution speed of the recovery screw 6 is also enabled.

In the developing device 4 of the present embodiment, for example, the outer diameter of the developing roller 5 is 18 mm, the outer diameter of the recovery screw 6 is 16 mm, and the outer diameter of the stirring screw 11 and feed screw 8 is 14 mm.

Circulation of developer in the developing device 4 will be explained below.

Figure 13:
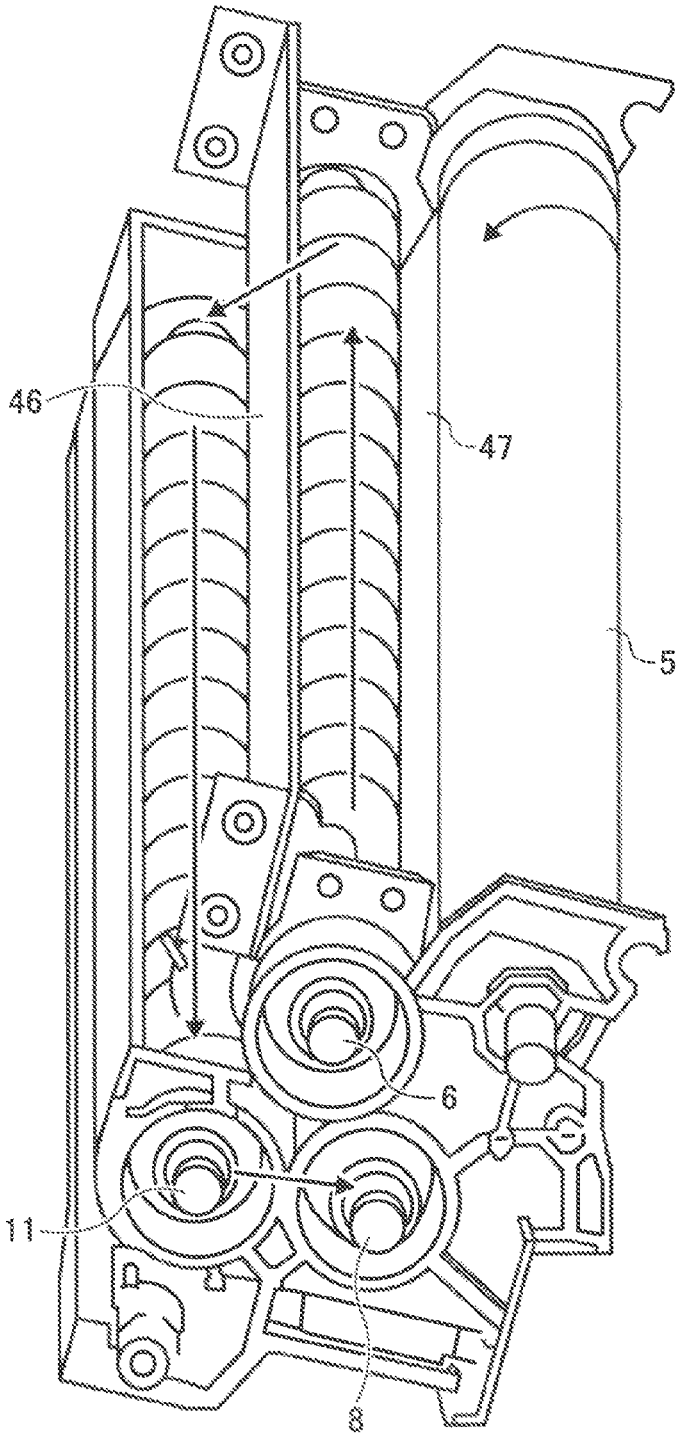
FIG. 13 is a perspective view illustrating a state in which the upper cover of the developing device is removed.
Figure 14:
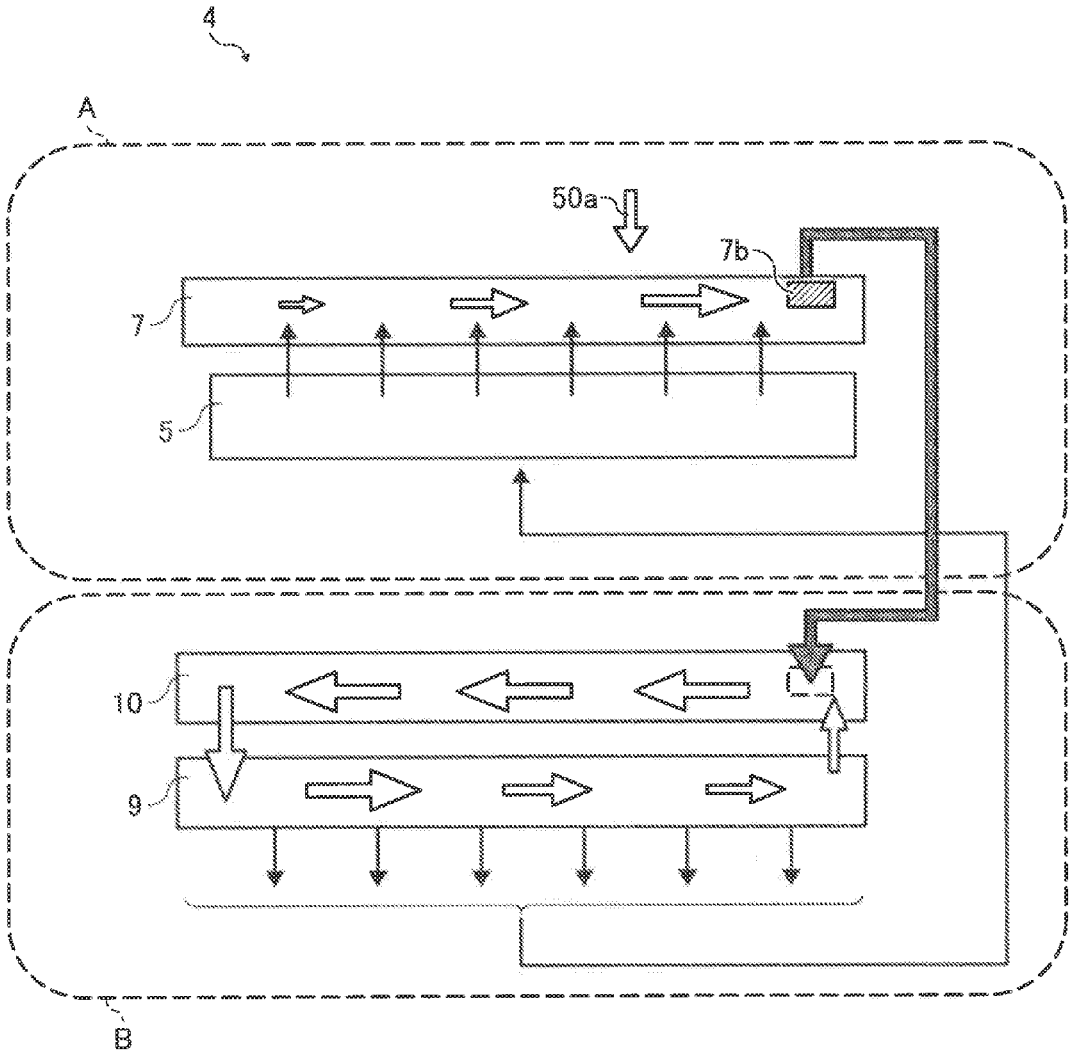
FIG. 14 is a schematic drawing illustrating a first example of developer flow in the developing device.

FIG. 13 shows a state after the upper cover of the developing device 4 has been removed. FIG. 14 shows the first row of developer flow inside the developing device 4.

In FIGS. 13 and 14, the flow of developer inside the developing device 4 is shown by arrows. In FIG. 14 the upper and lower parts of the developing device 4 are formally denoted by A and B.

The recovered developer in the recovering and conveying path 7 is conveyed by the recovery screw 6 so that the amount of developer increases in the downstream direction, and in the intermediate section of this path, the unused toner 50*a* is replenished with a toner replenishment device 50. The replenished unused toner 50*a* and recovered developer are thereafter conveyed, while being stirred, and fall down from a recovery downstream opening 7*b* provided below the recovery partition wall 46, which is a casing forming the recovering and conveying path 7, into the stirring and conveying path 10 located therebelow.

By transferring the recovered developer that is conveyed in the recovering and conveying path 7 into the stirring and conveying path 10, the effect of image density decrease caused by penetration of the recovered developer into the feeding and conveying path 9 can be prevented. Further, the transfer of developer from the downstream end of the recovering and conveying path 7 to the downstream end of the feeding and conveying path 9 generates decrease in image density caused by return of the recovered developer to the feeding and conveying path 9. In addition, by extending the downstream zone of the feeding and conveying path 9 to the outside of the image region increases the size of developing device 4. Therefore these problems can be resolved.

Further, the following problems arise when the replenished unused toner 50*a* is fed in a state in which it is not sufficiently dispersed in the upstreammost zone of the feeding and conveying path 9: uniformity of toner concentration on the developing roller 5 is not maintained and difference in image concentration occurs, and the toner is scattered on the developing roller 5 and the roller surface is roughened and contaminated. In the developing device 4 explained with reference to FIG. 14, by replenishing toner in the intermediate zone of the recovering and conveying path 7, it is possible to enlarge the distance through which the replenished toner is conveyed and increase the diffusion ability. Furthermore, the stability of toner concentration can be maintained because the replenished toner is reliably dispersed by passing through two transfer portions: from the recovering and conveying path 7 to the stirring and conveying path 10, and from the stirring and conveying path 10 to the feeding and conveying path 9.

Figure 15:
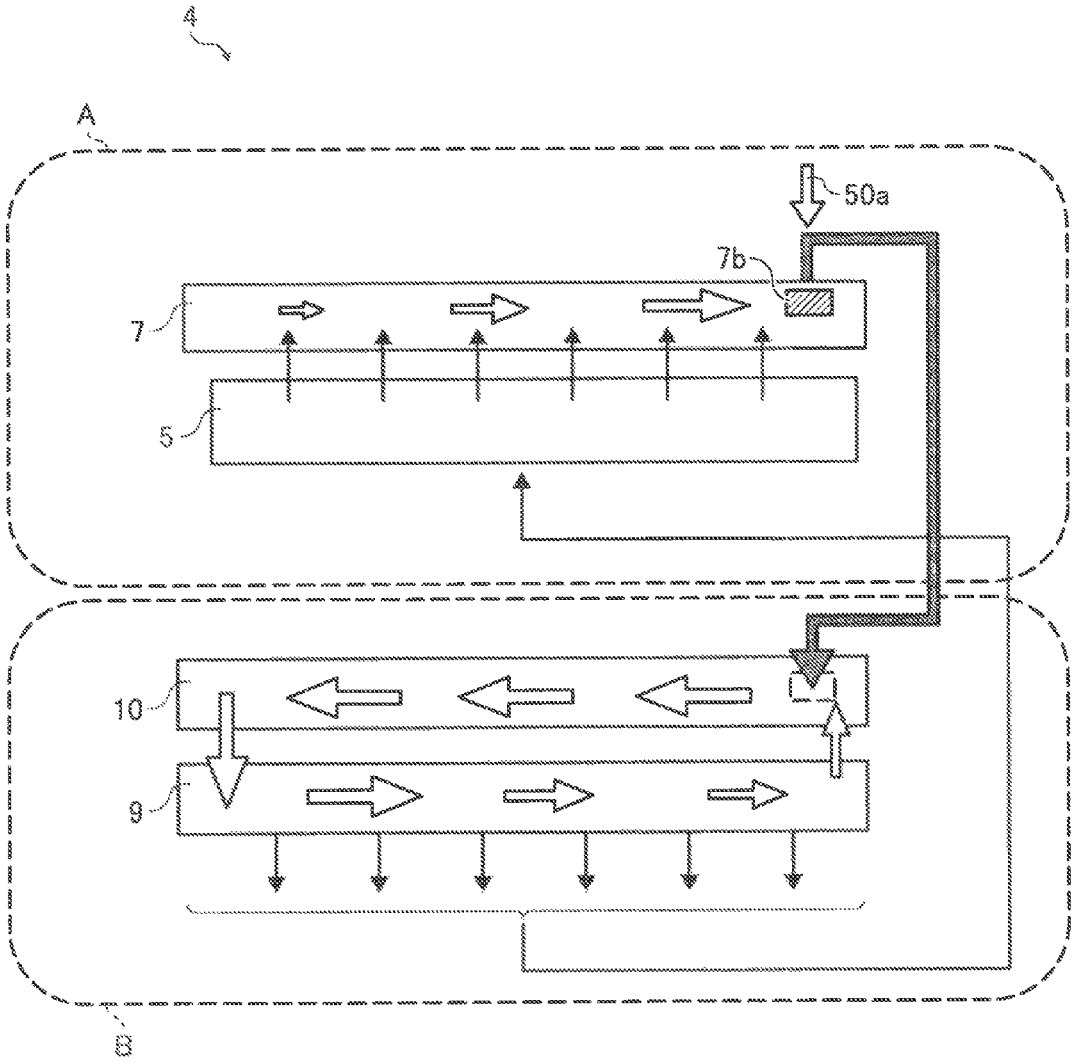
FIG. 15 is a schematic drawing illustrating a second example of developer flow in the developing device.

The position for replenishing the unused toner is not limited to the intermediate position of the recovering and conveying path 7. FIG. 15 shows the second example of developer flow inside the developing device 4.

The developing device 4 shown in FIG. 15 has a configuration in which the unused toner 50*a* is replenished above a recovery downstream opening 7*b* in which the recovered developer is transferred from the recovering and conveying path 7 to the stirring and conveying path 10. By replenishing the unused toner 50*a* above the recovery downstream opening 7*b*, the toner replenishment is performed, while the recovered developer is mixed with the toner during falling, and stirring ability is improved. Further, because the toner replenishment device 50 can be disposed in the end portion at the downstream side of the recovering and conveying path 7, the developing device can be further compacted.

Because toner replenishment is thus performed above the recovery downstream opening 7*b* in which the developer located in the recovering and conveying path 7 falls down, the replenished toner falls down, while mixing with the developer, and therefore diffusion ability is improved. As a result, the replenished unused toner 50*a* is dispersed efficiently within a small conveying distance and, therefore, stability of toner concentration can be maintained. Further, because the toner replenishment device 50 can be disposed in the end portion, space taken by the printer 100 can be saved.

The toner replenishment device 50, which is toner replenishment means, will be described below.

Figure 16A:
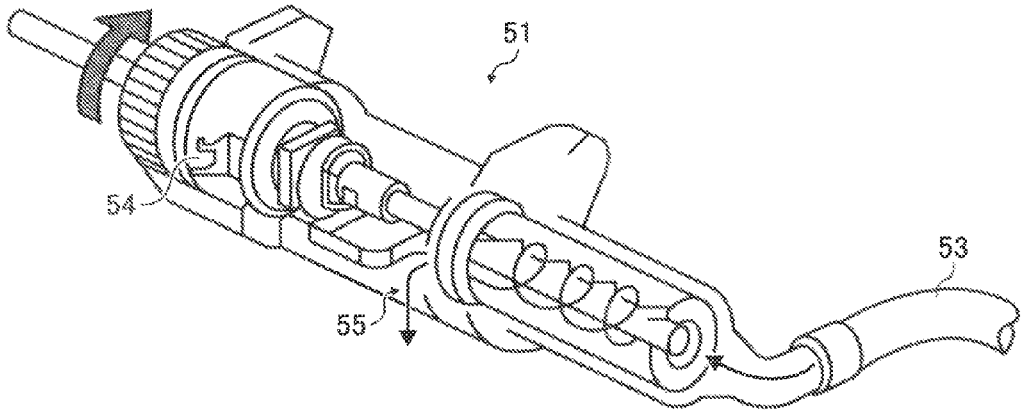
FIG. 16A illustrates schematically a toner conveying pump using a monopump as toner conveying means.
Figure 16B:
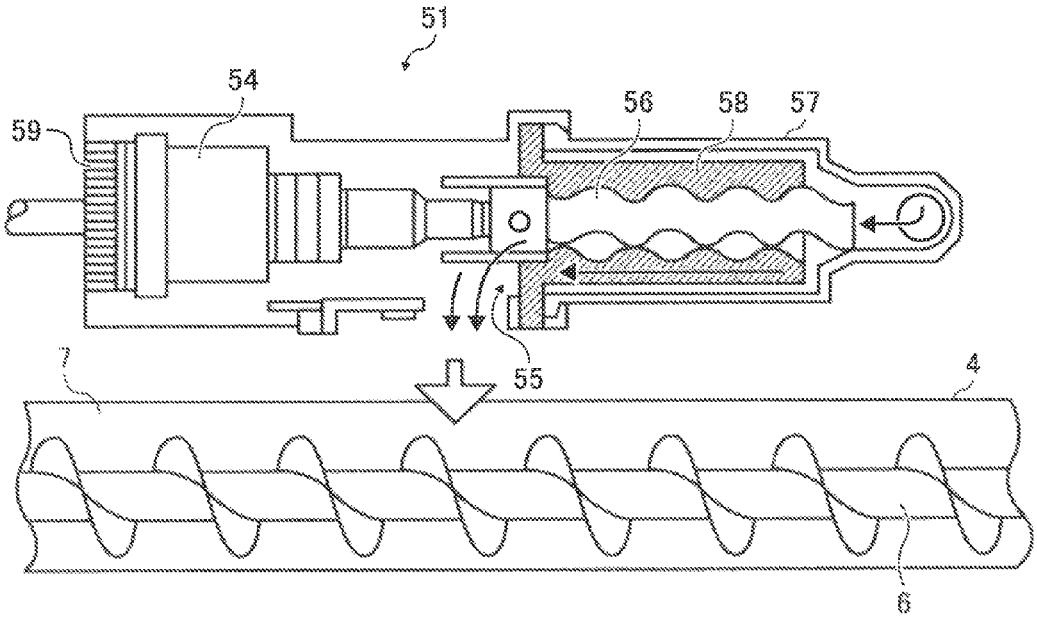
FIG. 16B is a cross-sectional view showing a schematic configuration to the toner conveying path.

The toner replenishment device 50 can use a monopump as toner conveying means for conveying an unused toner from a toner bottle 52 to the developing device 4. FIGS. 16A and 16B show a toner conveying pump 51 using a monopump as toner conveying means.

In the printer 100 of the present embodiment, the unused toner located in the toner bottle 52 is fed into the toner conveying pump 51 via a toner replenishing and conveying tube 53.

As shown in FIGS. 16A and 16B, the toner conveying pump 51 comprises a roller 56 in the form of an eccentric screw made from a rigid material such as metal or resin, a stator 57 having a twin-screw internal shape and made from a rubber material, and a holder 58 enclosing the two aforementioned members. The toner replenishing and conveying tube 53, which is a toner replenishing and conveying path composed of a tube, is attached to one end of the toner conveying pump 51 and connected to the toner bottle 52. Where the roller 56 is rotated by a drive motor 59, a suction pressure is generated inside the toner conveying pump 51, and the inside of the toner replenishing and conveying tube 53 is evacuated and a negative pressure is generated therein. As a result, the toner located in the toner bottle 52 is transferred by a suction force and can be fed from a toner replenishment port 55 to the inside of the developing device 4. By controlling the rotation operation (time) of the roller 56 with a replenishment clutch 54 connected to the drive motor 59, it is possible to set finely the replenished amount of the toner. The toner replenishment operation is performed by calculating the necessary amount of toner mainly from the output value of a toner concentration sensor 27, so that the toner concentration of the developer inside the developing device 4 is stabilized.

In the developing device 4, the recovered developer from the recovering and conveying path 7 and the excess developer from the feeding and conveying path 9 flow into the stirring and conveying path 10. These developers are conveyed, while being stirred, toner concentration therein is made uniform, and the developers are fed to the upstreammost portion of the feeding and conveying path 9. In the feeding and conveying path 9, the developer is fed to the developing roller 5 and the developer is conveyed downstream, while the amount thereof is being decreased. Here, the height of developer bulk inside the feeding and conveying path 9 has to be maintained even in a state where the amount of developer conveyed per unit time inside the feeding and conveying path 9 decreases due to the feeding of the developer to the developing roller 5 on the downstream side in the conveying direction of the feed screw 8. If the height of developer bulk inside the feeding and conveying path 9 cannot be maintained, the amount of developer fed from the feeding and conveying path 9 to the developing roller 5 becomes unstable and image density also becomes unstable.

Increasing the amount of developer contained in the entire feeding and conveying path 9 can be considered as means for maintaining the height of developer bulk even on the downstream side inside the feeding and conveying path 9 where the amount of developer fed per unit time decreases. However, in the configuration shown in FIG. 6 in which the recovering and conveying path 7 is present above the feeding and conveying path 9, a limitation is placed on the amount of developer that can stay on the upstream side of the feeding and conveying path 9. Further, if conveying ability in the feeding and conveying path 9 deteriorates, the bulk of developer decreases in height on the downstream side of the feeding and conveying path 9, the developer is not scooped up appropriately to the developing roller 5, sufficient development capacity is not obtained, and image density decreases.

In order to resolve this problem, the feed screw 8 of the developing device 4 of the present embodiment has a configuration in which the pitch width of the blade is smaller on the downstream side in the conveying direction than on the upstream side in the conveying direction. The feed screw 8 will be described below in greater detail.

Figure 17:
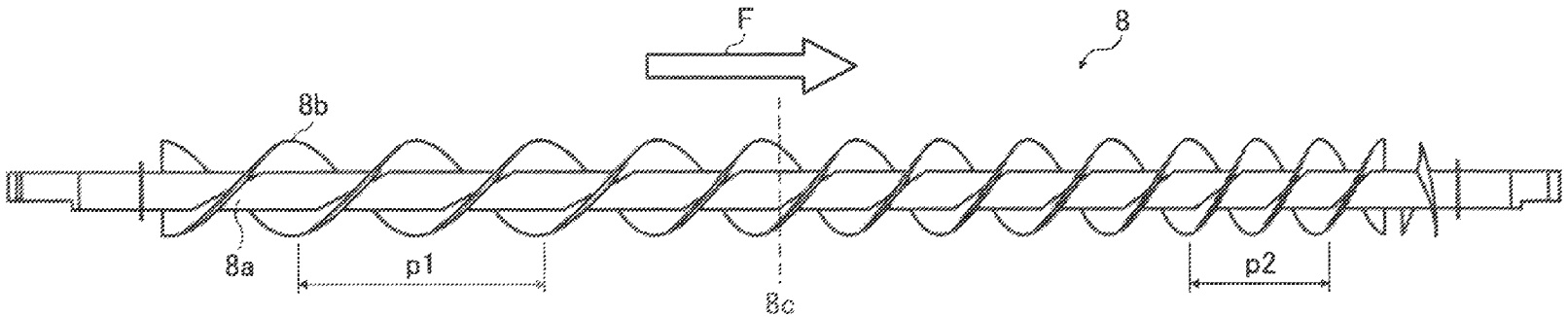
FIG. 17 is a side view illustrating a configuration of a feed screw of the developing device.

FIG. 17 is a side view of the feed screw 8. The feed screw 8 has a shape in which a feed blade 8*b*, which is a spiral blade, is provided on the feed rotary shaft 8*a*. Arrow F in FIG. 17 is the conveying direction of the developer. As shown in the figure, the blade has a configuration such that the pitch width p2 of the feed blade 8*b* on the downstream side of a central portion 8*c* in the conveying direction is less than a pitch width p1 of the feed blade 8*b* on the upstream side of the central portion 8*c* of the feed screw 8 in the conveying direction. Thus, the pitch width of the feed blade 8*b* of the feed screw 8 decreases toward the downstream side in the conveying direction of the developer.

Figure 18:
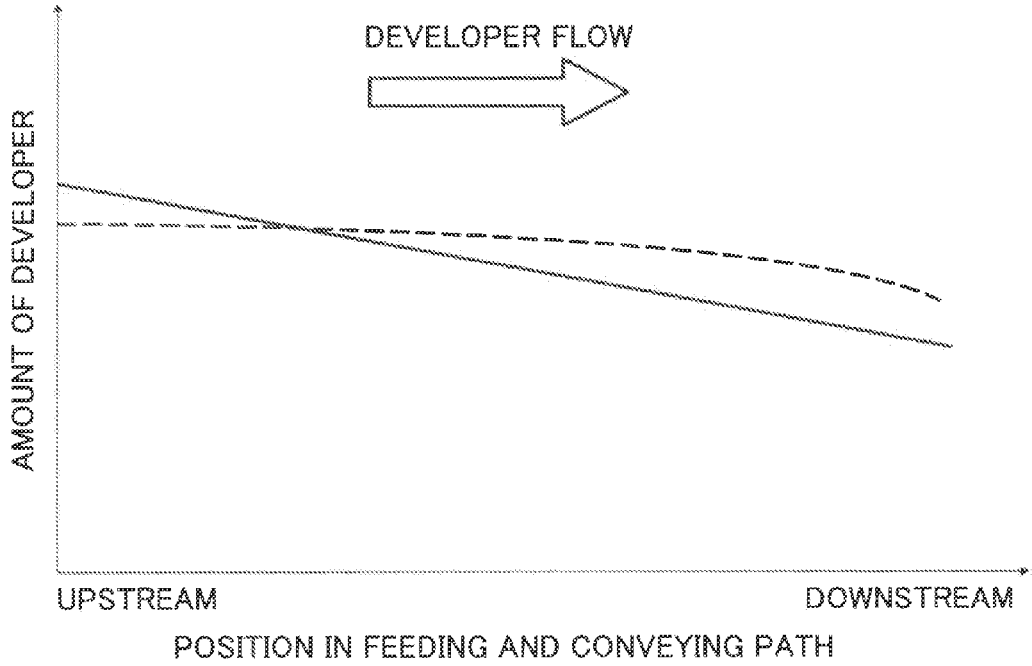
FIG. 18 is a graph showing the variation in the amount of developer depending on the position in the developer conveying direction in a configuration in which the pitch width of feeding blades of the feed screw is fixed and a configuration in which the pitch width decreases toward the downstream side in the conveying direction.

FIG. 18 is a graph representing the variation of developer amount with the position in the developer conveying direction for the feed screw 8 with a fixed pitch width of feed blade 8*b* and the feed screw un which the pitch width decreases toward the downstream side in the conveying direction of the developer. In the graph of FIG. 18, a position in the longitudinal direction that is the developer conveying direction in the feeding and conveying path 9 is plotted against the abscissa, and the amount of developer in this location is plotted on the ordinate. A solid line in FIG. 18 is a graph representing the variation of developer amount with the position in the developer conveying direction for the case of using the feed screw 8 with a fixed pitch width of the feed blade 8*b*. A broken line in FIG. 18 is a graph representing the variation of developer amount with the position in the developer conveying direction for the case of using the feed screw 8 in which the pitch width of the feed blade 8*b* decreases toward the downstream side in the developer conveying direction. As shown in FIG. 18, by using the feed screw 8 of a shape such that the pitch width is smaller on the downstream side makes it possible to reduce the amount of developer on the downstream side in the conveying direction and obtained a more uniform amount of developer over the entire range than in the case of a feed screw with a fixed pitch width. As a result, a more stable feed of developer can be performed to the developing roller on the downstream side in the conveying direction.

As shown in FIG. 17, by making the pitch width in the zone downstream of the central portion 8*c* smaller than the pitch width in the upstream portion, it is possible to reduce the conveyance speed of developer from the central portion 8*c* toward the downstream end and retain the developer for a longer time, thereby enabling the increase in the amount of developer in this portion. As a result, margin for scooping up the developer with the developing roller 5 on the downstream side in the conveying direction of the feed screw 8 can be increased. Therefore, high toner concentration stability can be obtained.

Operation of the developing device 4 will be described below.

Figure 19:
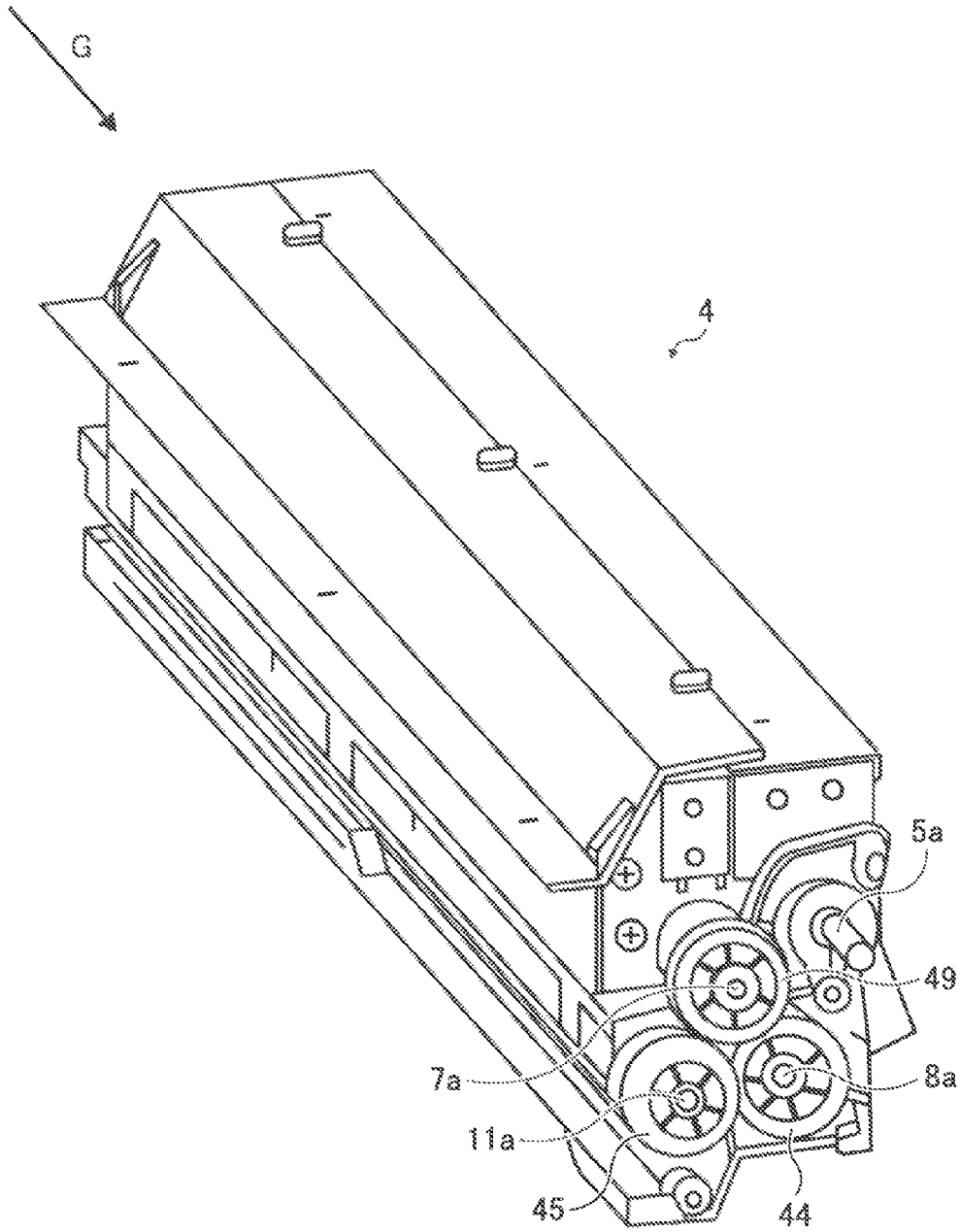
FIG. 19 is a perspective view illustrating a configuration of the developing device.

FIG. 19 illustrates an external view of the developing device 4. Further, FIG. 20 shows the developing device 4, wherein the developing device 4 shown in FIG. 19 is viewed from the far back side (direction of arrow G in FIG. 19).

Figure 20:
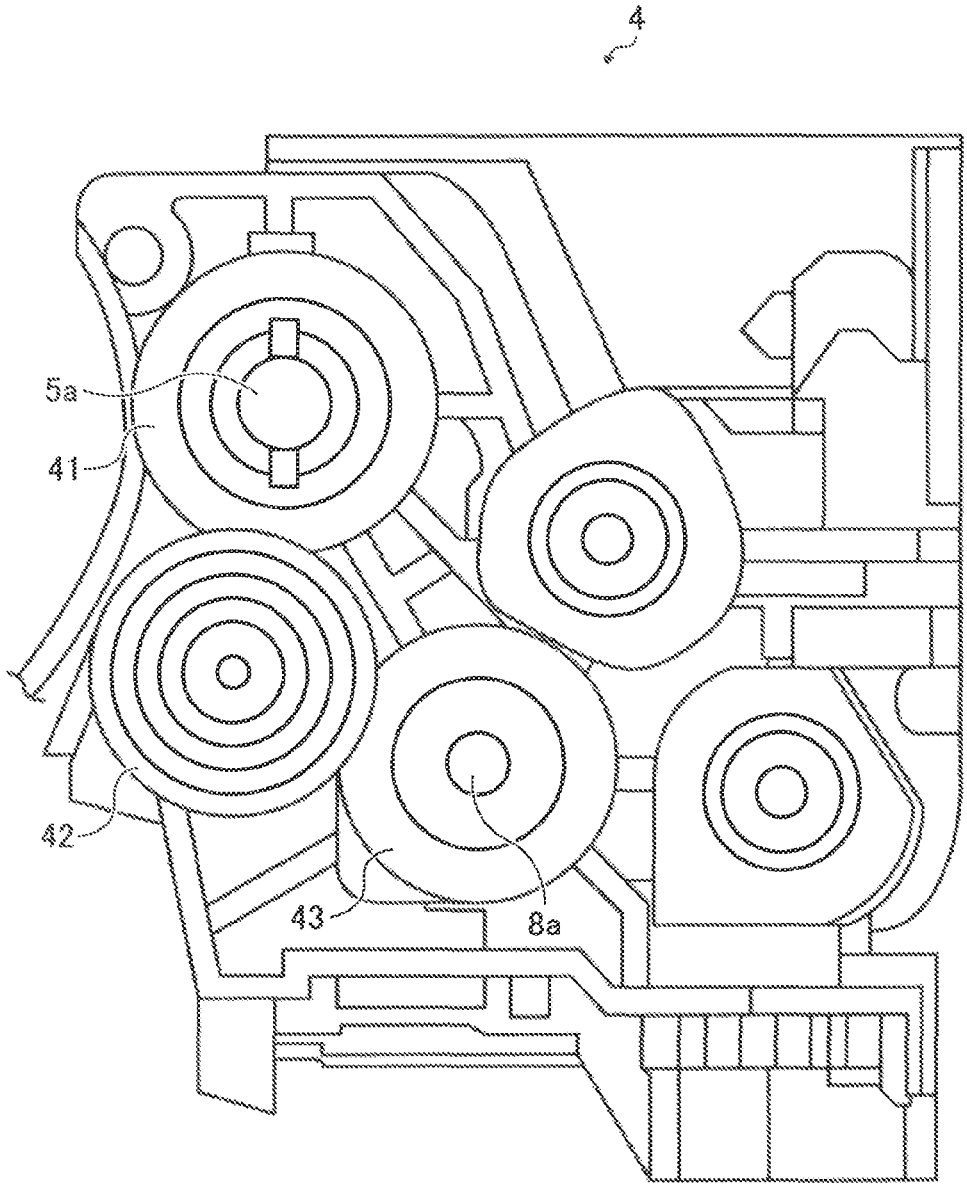
FIG. 20 is an external side view in which the inside of the developing device is viewed from the direction G in FIG. 19.

As shown in FIG. 20, on the side surface on the far back side of the developing device 4, there are provided a feed gear 43 that can rotate about the feed rotary shaft 8*a* and a development gear 41 that can rotate about the development rotary shaft 5*a*. The feed gear 43 and development gear 41 are engaged with an idle gear 42 that transmits power from a drive source (not shown in the figure). When the developing device 4 is operated, power is inputted from a drive source (not shown in the figure) of the printer 100 to the idle gear 42 and distributed to the feed gear 43 and development gear 41. The feed screw 8 and developing roller 5 are thus rotated.

As shown in FIG. 19, on the side surface on the front side of the developing device 4, there are provided a feed drive transmission gear 44 that can rotate about the feed rotary shaft 8*a*, a stirring gear 45 that can rotate about the stirring rotary shaft 11*a*, and a recovery gear 49 that can rotate about the recovery rotary shaft 6*a*. The stirring gear 45 and recovery gear 49 are engaged with the feed drive transmission gear 44. Where the feed screw 8 is rotated, drive power is transmitted to the feed drive transmission gear 44 via the feed rotary shaft 8*a*, and the power is distributed to the stirring gear 45 and recovery gear 49. By this, the recovery screw 6 and the stirring screw 11 rotate.

Here, the revolution speed of the feed screw 8, recovery screw 6, and stirring screw 11 is preferably not more than 1.5 times the revolution speed of the developing roller 5 (it is the development sleeve 5*s* that actually rotates).

The developing device 4 of the present embodiment comprises three developer conveying screws, namely, the feed screw 8, recovery crew 6, and stirring screw 11, and there is a risk of making the drive more complex and the layout larger than in the conventional configuration comprising only two developer conveying screws. By making the revolution speed of the feed screw 8, recovery screw 6, and stirring screw 11 not more than 1.5 times the revolution speed of the developing roller 5, it is possible to transmit drive power to each developer conveying screw by gear engagement from the idle gear 42 that transmits drive power to the developing roller 5. Because transmission of drive power can be received from the idle gear 42, it is possible to obtain space-saving layout in each developer conveying screw is rotated. It is more preferred that the aforementioned revolution speed ratio be 1.3 or less times. Where the revolution speed ratio is more than 1.5 times, it is necessity either to install additionally an idler or to provide a separate drive source for the developer conveying screws, thereby increasing the size and complexity of the device.

Further, where the revolution speed of developer conveying screws is by a factor of more than 1.5 higher than the revolution speed of the development sleeve 5*s*, a load applied to the drive unit due to rising torque increases, making it necessary to increase the size of development gear 41 and thereby increasing the device in size. By reducing the revolution speed ratio of the development sleeve 5*s* and developer conveying screws as much as possible, it is possible to make the developing device 4 more compact. In the developing device 4 of the present embodiment, revolution speed of the development sleeve 5*s* is 425 rpm and the revolution speed of the developer conveying screws is 480 rpm. However, the revolution speeds are not limited to these values.

By equipping the printer 100 with the developing device 4 of the present embodiment as development means, it is possible to obtain a stable amount of attached toner at all time over a long period, regardless of the image pattern. Therefore, an image forming apparatus with high stability of image density can be provided. Furthermore, because the stability of image density is high, the printer 100, which is a color image forming apparatus using toners of four colors, can produce high-quality color images with excellent color reproducibility and color balance.

Characteristics of the developer used in the developing device 4 of the present embodiment will be described below.

A volume-average particle size of the magnetic carrier contained in the developer is preferably within a range of 20 to 60 μm. By using a carrier comprising small particles with an average particle size of 60 μm or less, the scooped-up amount can be reduced and the amount of developer circulating in the developing device can be decreased without reducing the developing capacity. In particular, because the amount of developer passing through a developer control member where stresses are applied is decreased, service life of developer can be extended. In addition, because a magnetic brush becomes denser in the development region, higher image quality and image stability can be attained. Further, where the average particle size of the carrier is more than 60 μm, overflow easily occurs in the developer circulation portion and stable developer circulation cannot be performed. Problems arising when the average particle size of the carrier is less than 20 μm include adhesion of the carrier to the photosensitive body and scattering of the carrier from the developing unit.

The average particle size of the carrier can be measured by using a Microtrack Particle Size Analyzer of an SRA type (manufactured by Nikkiso Co., Ltd.) within a set range of 0.7 μm or more to 125 μm or less.

Characteristics of the toner contained in the developer used in the developing device 4 of the present embodiment will be described below.

The volume-average particle size of the toner is preferably 3 to 8 μm. Where a toner with a small particle size and a sharp particle size distribution is used, gaps between the toner particles are decreased, thereby making it possible to reduce the necessary amount of adhered toner, without losing color reproducibility. Further, color reproducibility of fine dot images of 600 dpi or more can be increased and high image quality that is stable over a long period can be obtained. On the other hand, where the volume-average particle size (D4) of the toner is less than 3 μm, adverse effects such as reduction in transfer efficiency and decrease in blade cleaning ability can easily occur. Where the volume-average particle size (D4) of the toner exceeds 8 μm, flowability of the developer is deteriorated, a pile height of images increases, scattering of letters or lines is difficult to inhibit, and stable long-term image quality is difficult to maintain. At the same time, it is preferred that a ratio (D4/D1) of the weight-average particle size (D4) and number-average particle size (D1) be within a range of 1.00 to 1.40.

The closer is the D4/D1 ratio to 1.00, the sharper is the particle size distribution. With a toner having such small particle size and narrow particle size distribution, the charge amount distribution of the toner becomes uniform, high-grade images with small background fogging can be obtained, and transfer efficiency in an electrostatic transfer system can be increased.

A method for measuring the particle size distribution of toner particles will be explained below.

A Coulter Counter TA-II and Coulter Multisizer II (both are manufactured by Coulter Co., Ltd.) can be used for measuring particle size distribution of toner particles by a Coulter counter method.

The measurement method will be described below.

Fist, 0.1 to 5 mL of a surfactant (preferably, an alkylbenzenesulfonate) is added as a dispersant to 100 to 150 mL of an electrolytic aqueous solution. Here, the electrolytic solution is an aqueous NaCl solution with a concentration about 1% prepared by using 1-grade sodium chloride. For example, ISOTON-II (product of Coulter Co., Ltd.) can be used. A measurement sample is added thereto at 2 to 20 mg. The electrolytic solution having the sample suspended therein is dispersion treated for about 1-3 minutes in an ultrasound dispersion device, the volume and number of toner particles are measured with the aforementioned measurement device by using a 100-1 μm aperture, and volume distribution and particle number distribution are calculated. The weight-average particle diameter (D4) and number-average particle diameter (D1) of the toner can be found from these distributions.

A total of 13 channels were used: 2.00 μm to less than 2.52 μm, 2.52 μm to less than 3.17 μm, 3.17 to less than 4.00 μm, 4.00 μm to less than 5.04 μm, 5.04 μm to less than 6.35 μm, 6.35 μm to less than 8.00 μm, 8.00 μm to less than 10.08 μm, 10.08 μm to less than 12.70 μm, 12.70 μm to less than 16.00 μm, 16.00 μm to less than 20.20 μm, 20.20 μm to less than 25.40 μm, 25.40 μm to less than 32.00 μm, and 32.00 μm to less than 40.30 μm, and particles with a size of from not less than 2.00 μm to less than 40.30 μm were the measurement objects.

Figure 21:
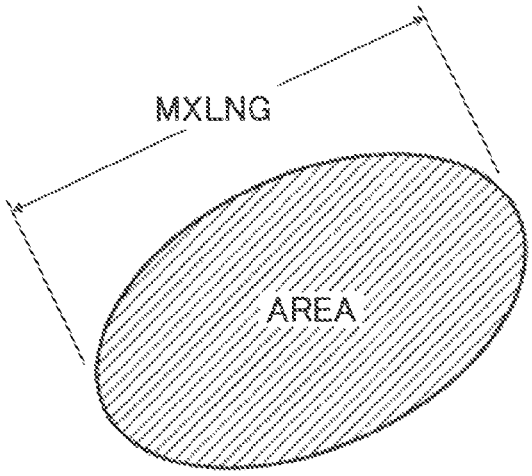
FIG. 21 is a schematic view for explaining the shape factor SF-1.
Figure 22:
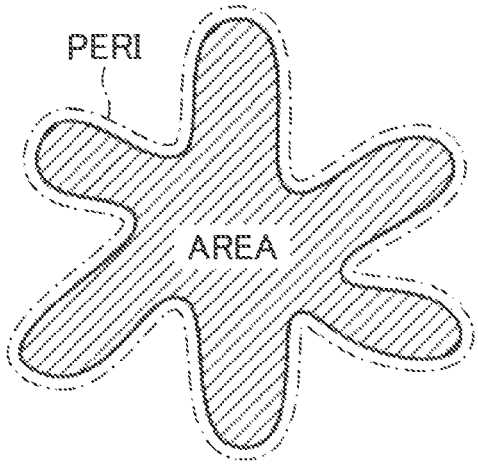
FIG. 22 is a schematic view for explaining the shape factor SF-2.

The shape factor SF-1 of the toner is preferably within a range of 100 to 150 and the shape factor SF-2 is preferably within a range of 100 to 150. FIGS. 21 and 22 represent schematically the toner shape for explaining the shape factor SF-1 and shape factor SF-2. The shape factor SF-1 indicates the degree of roundness of the toner shape and is represented by Equation (1) below. The value of this shape factor is obtained by dividing a second power of the maximum length MXLNG of the shape obtained by projecting the toner on a two-dimensional plane by a figure surface area AREA and multiplying the result by 100π/4.

$$SF\text{-}1=\{(MXLNG)^2/\mathrm{AREA}\}\times(100\pi/4) \qquad \text{Equation (1)}$$

When the value of shape factor SF-1 is 100, the toner particles have a spherical shape, and the shape becomes indeterminate as the value of SF-1 increases.

The shape factor SF-2 indicates the degree of peaks and valleys in the toner shape and is represented by Equation (2) below. The value of this shape factor is obtained by dividing a second power of the perimeter PERI of the shape obtained by projecting the toner on a two-dimensional plane by a figure surface area AREA and multiplying the result by 100/4π.

$$SF\text{-}2=\{(PERI)^2/\mathrm{AREA}\}\times(100/4\pi) \qquad \text{Equation (2)}$$

When the value of shape factor SF-2 is 100, peaks and valleys are not present on the toner surface, and peaks and valleys become larger as the value of SF-2 increases.

In order to calculate the shape factors, a toner photograph is taken with a scanning electron microscope (S-800, manufactured by Hitachi, Ltd.), and the photo is introduced in an image analyzer (LUSEX3, manufactured by Nireco Corporation) and analyzed.

Where the toner shape is close to spherical, the contact state between toner particles becomes that of point contact, the attachment force between the toner particles weakens, and flowability of toner increases. As a result, circulation ability of the developer is improved. Therefore, stable unidirectional circulation can be carried out for a long time at a low stress level, and image density can be stabilized. Further, because a state of contact between the toner and photosensitive body is that of point contact, the attachment force between the toner and photosensitive body weakens, transfer ratio rises, and image quality is improved. On the other hand, where each of the shape factors SF-1, SF-2 is above 150, flowability deteriorates, and circulation ability of the developer becomes poor. Another undesirable consequence is that transfer efficiency decreases.

In the toner for use in the developing device 4 of the present embodiment, microparticles with an average primary particle size of 50 to 500 nm and bulk density of 0.3 mg/cm$^3$ or more (referred to hereinbelow simply as microparticles) are attached to the surface of toner particles. Silica or the like is often used as a usual flowability improving agent. For example, such silica usually has an average primary particle size of 10 to 30 nm and a bulk density of 0.1 to 0.2 mg/cm$^3$.

In the developing device 4, due to the presence of microparticles with adequate characteristics on the surface of toner particles, appropriate gaps are formed between the toner particles and an object. Further, because a contact surface area of microparticles with toner particles, photosensitive body, and charge imparting member is extremely small and uniform contact therebetween is realized, the attachment force is effectively reduced and the development-transfer efficiency is increased. In addition, flowability of developer is also increased, thereby reducing stresses and making contribution to service life extension. Further, because the microparticles serve as rollers, the toner does not wear or damage the photosensitive body, the microparticles are hardly embedded in the toner particles even in the course of cleaning under high stresses (high load, high speed, etc.) applied by the cleaning blade and photosensitive body, and even if the microparticles are slightly embedded in the toner particles, they can be separated and recycled, thereby making it possible to obtain characteristics stable over a long period. Yet another positive effect is that the so-called "dam effect" in which microparticles are appropriately separated from the toner surface and accumulate on the distal end portion of the cleaning blade prevents the phenomenon of toner passing from the blade. These characteristics indicate an action that decreases shear forces acting upon the toner particles. Therefore, an effect of reducing filming of the toner itself caused by low-rheology components contained in the corner due to high-speed fixing (low-energy fixing) is demonstrated. Moreover, where particles with an average primary particle size of 50 to 500 μm are used as the microparticles, excellent cleaning performance thereof can be demonstrated to full extent, and because the particle size is extremely small, flowability of toner powder is not decreased. Where surface-treated microparticles are externally added to the toner, the degree of developer deterioration is small even if the carrier is contaminated. Therefore variations of flowability and charging ability of toner with time are small and, therefore, circulation of developer can be performed with good stability over a long period. Stability of image quality is also improved.

Microparticles with an average primary particle size (referred to hereinbelow as average particle size) of 50 to 500 nm can be used, and a particle size of 100 to 400 nm is particularly preferred. Where the particle size is less than 50 nm, microparticles are sometimes embedded into concave portions present on the toner surface and the efficiency thereof as rollers is reduced. On the other hand, if the particle size is more than 500 μm, when the microparticles are located between the blade and photosensitive body surface, the contact surface area thereof becomes of the same order as that of the toner itself, and toner particles that have to be cleaned are passed, that is, insufficient cleaning easily occurs.

Where the bulk density is less than 0.3 mg/cm$^3$, although a certain contribution is made to the improvement of flowability, scattering ability and adhesion ability of toner and microparticles increases. As a result, the effects thereof as a toner and rollers, accumulation of toner at the cleaning portion, and the so-called dam effect preventing insufficient cleaning of toner are reduced.

Examples of microparticles of the developer that can be used in the developing device 4 include $SiO_2$, $TiO_2$, $Al_2O_3$, MgO, CuO, ZnO, $SnO_2$, $CeO_2$, $Fe_2O_3$, BaO, CaO, $K_2O$, $Na_2O$, $ZrO_2$, $CaO{\bullet}SiO_2$, $K_2O(TiO_2)_n$, $Al_2O_3{\bullet}2SiO_2$, $CaCO_3$, $MgCO_3$, $BaSO_4$, $MgSO_4$, and $SrTiO_3$. The preferred among them are $SiO_2$, $TiO_2$, and $Al_2O_3$. In particular, these inorganic compounds may be subjected to hydrophobization treatment with a variety of coupling agents, hexamethylsilazane, dimethyldichlorosilane, and octyltrimethoxysilane.

Further, thermoplastic resins and thermosetting resins may be also used as microparticles of organic compounds. Examples of such resins include vinyl resins, polyurethane resins, epoxy resins, polyester resins, polyamide resins, polyimide resins, silicone resins, phenolic resins, melamine resins, urea resins, aniline resins, ionomer resins, and polycarbonate resins. The aforementioned resins of two or more types may be used together. From the standpoint of obtaining aqueous dispersions of fine spherical resin particles, vinyl resins, polyurethane resins, epoxy resins, polyester resins, and combinations thereof are preferred.

Specific examples of vinyl resins include polymers obtained by homopolymerization or copolymerization of vinyl monomers, such as styrene-(meth)acrylic acid ester copolymers, styrene-butadiene copolymers, (meth)acrylic acid-acrylic acid ester copolymers, styrene-acrylonitrile copolymers, styrene-maleic anhydride copolymers, and styrene-(meth)acrylic acid copolymers.

Bulk density of microparticles is measured by the following method. Microparticles are gradually added to a measuring cylinder having a capacity of 100 mL to obtain a volume of microparticles of 100 mL. Vibrations are applied to the cylinder in this process. The bulk density is measured by the difference in weight before and after the addition of microparticles to the measuring cylinder.

Bulk density (g/cm$^3$)=amount of microparticles (g/100 mL)+100

A method of mechanically mixing and attaching microparticles to toner base particles by using a mixing device of a variety of well-known types can be used as a method for externally adding and attaching microparticles of the developer used in the developing device 4 to the toner surface. Further, another suitable method comprises the step of homogeneously dispersing toner base particles and microparticles in a liquid phase by using a surfactant or the like, performing an attachment treatment, and then drying.

With the above-described embodiment, the stirring rotary shaft 11*a* that is the rotary shaft of the stirring screw 11 and the feed rotary shaft 8*a* that is the rotary shaft of the feed screw 8 are disposed so that the central positions of rotary shafts are at almost the same height, and the recovery rotary shaft 6*a* that is the rotary shaft of the recovery screw 6 is disposed so that the central position of the rotary shaft is higher than the central positions of the stirring rotary shaft 11*a* and feed rotary shaft 8*a*. Thus, the stirring screw 11 and stirring and conveying path 10 are at almost the same height as the feed screw 8 and feeding and conveying path 9, and the recovering and conveying path 7 is disposed higher than other two developer conveying paths. As a result, it is not necessary to raise the developer up when the developer is circulated and conveyed in the developer conveying paths, application of excess stress to the developer can be prevented, and stresses applied to the developer can be reduced.

Furthermore, the rotation central position of the recovery rotary shaft 6*a* that is the rotary shaft of the recovery screw 6 is set lower that the rotation central position of the development rotation shaft 5*a* that is the rotary shaft of the developing roller 5, and the recovery screw 6 and recovering and conveying path 7 are positioned lower than the developing roller 5. As a result, the on-roller developer recovery portion 7*a* where the developer located on the developing roller 5 is recovered and fed to the recovering and conveying path 7 can be set in a position lower than that of the developing roller 5, and the inclination of the normal line of the surface of the developing roller 5 in the on-roller developer recovery portion 7*a* with respect to a horizontal plane can be increased. Therefore, the component of gravity acting upon the developer in the on-roller developer recovery portion 7*a* that acts toward the development rotary shaft 5*a* of the developing roller 5 can be reduced with respect to that in the conventional devices, and the developer can be easily separated form the surface of the developing roller 5. As a result, the slipping of the developer through the on-roller developer recovery portion 7*a* in a state where the developer is supported on the surface of the developing roller 5 is inhibited and the recovery of the developer to the recovering and conveying path 7 is enhanced, whereby the recovery ratio of the developer present on the surface of the developing roller 5 can be increased. By inhibiting the slipping of the developer through the on-support developer recovery portion 7*a* in a state where the developer is supported on the surface of the developing roller 5 makes it possible to prevent local decrease in toner concentration occurring when the developer that was used for development rotates together with the surface of the developing roller 5 and reaches the feeding and conveying path 9. As a result, image formation with a stable image density can be performed.

The casing that forms the recovering and conveying path 7 comprises a recovery partitioning wall 46 that partitions the developing roller 5 and recovery screw 6 and an opening linked to the space where the recovering and conveying path 7 and developing roller 5 are disposed is formed above the recovery partitioning wall 46, thereby making it possible to move the recovered developer from above the recovery partitioning wall 46 to the recovering and conveying path 7.

Further, the upper end of the partitioning wall upper end member 47 provided at the upper end of the recovery partitioning wall 46 is arranged in a position that is by h higher than the central position of the recovery rotary shaft 6*a* of the recovery screw 6. As a result, it is possible to retain a certain amount of the developer that is separated from the surface of the developing roller 5 and increases in quantity downstream of the recovery and conveying portion, without returning the developer to the feed portion.

Further, because the upper end of the recovery partitioning wall 46 is in a position lower than the central position of the development rotary shaft 5*a* of the developing roller 5, gravity easier participates in the separation of the developer from the surface of the developing roller 5 and the recovery ratio of the recovered developer can be increased.

Further, an angle θ between the partition wall upper end member 47 provided at the upper end of the recovery partition wall 46 on the side of the developing roller 5 and a horizontal plane of the surface facing the recovery screw 6 is set to 60° or more. As a result the recovered developer that is separated from the developing roller 5 faster falls down into the recovering and conveying path 7. Therefore, the amount of recovered developer that remains on the recovery partition wall 46, which is a recovery casing, and is not supplied to the recovery screw 6 can be decreased.

Further, a value of the normal component of magnetic flux density on the surface of the development sleeve 5*s* in a position (dot line) close to the on-roller developer recovery portion 7*a* where the partition wall upper end member 47 and the developing roller 5 face each other is 10 mT or less. As a result, it is possible to ensure reliable separation of developer to the recovering and conveying path 7 in the developing roller 5. Further, the recovered developer is prevented from being pulled back into the feed unit by magnetic forces, and stability of image density can be maintained.

Positioning the stirring screw 11 and feed screw 8 at almost the same height makes it unnecessary to raise the developer up during developer circulation in the stirring and conveying path 10 and feeding and conveying path 9. Therefore, stresses applied to the developer can be reduced.

In the recovery screw 6, the recovery blade 6*b* on the side of the developing roller 5 (right side in FIG. 11) rotates so as to move from above the recovery rotary shaft 6*a* to below this shaft, and the blade on the opposite side from the developing roller 5 (left side in FIG. 11) rotates so as to move from below the recovery rotary shaft 6*a* to above this shaft. As a result, the developer located in the recovering and conveying path 7 is conveyed, while being accumulated, in the direction from the developing roller 5. Therefore, it is made difficult for the recovered developer to return into the feeding and conveying path 9.

By making the outer diameter of the recovery screw 6 larger than the outer diameter of the stirring screw 11 and feed screw 8, the recovered developer can be more effectively prevented from returning to the feeding and conveying path 9.

By replenishing the toner in the intermediate zone of the recovering and conveying path 7, it is possible to extend the conveyance interval of the replenished toner and increase diffusion ability thereof. Further, because the replenished toner is dispersed more reliably by passing through two transfer portions, that is, from the recovering and conveying path 7 to the stirring and conveying path 10 and from the stirring and conveying path 10 to the feeding and conveying path 9, stability of image density can be maintained.

Further, by transferring the recovered developer that is conveyed in the recovering and conveying path 7 to the stirring and conveying path 10, the effect of image density decrease caused by penetration of the recovered developer into the feeding and conveying path 9 can be prevented. Further, the transfer of developer from the downstream end of the recovering and conveying path 7 to the downstream end of the feeding and conveying path 9 generates decrease in image density caused by return of the recovered developer to the feeding and conveying path 9. In addition, by extending the downstream zone of the feeding and conveying path 9 to the outside of the image region increases the size of developing device 4. Therefore these problems can be resolved.

Because the toner is replenished from above the recover downstream opening 7*b* through which the developer located in the recovering and conveying path 7 falls down, the replenished toner falls down, while mixing with the developer, and therefore diffusion ability is improved. As a result, the replenished unused toner 50*a* is dispersed efficiently within a small conveying distance and, therefore, stability of toner concentration can be maintained.

Further, because the pitch width of the feed blade 8*b* of the feed screw 8 decreases toward the downstream side in the conveying direction of the developer, a uniform developer amount can be obtained over the entire feeding and conveying path 9. As a result, stable developer feed can be carried out to the developing roller.

By making the revolution speed of each developer conveying screw not more than 1.5 times a revolution speed of the development screw 5*s*, compactness of the developing device 4 can be increased.

Because the surface of the developing roller 5 does not come into contact with the distal end of the partition wall upper end member 47 provided at the upper end of the recovery partition wall 46 on the side of the developing roller 5 and a predetermined gap is maintained therebetween, such problems as developer aggregation or toner fixation to the surface of the developer sleeve 5*s* can be prevented.

By providing the printer 100, which is an image forming apparatus, with the developing device 4 of the present embodiment as developing means, it is possible to obtain a stable amount of attached toner at all time over a long period, regardless of image pattern. Therefore, an image forming apparatus with high stability of image density can be provided.

Furthermore, because the stability of image density is high, the printer 100, which is a color image forming apparatus using toners of four colors, can produce high-quality color images with excellent color reproducibility and color balance.

By using a carrier with a small particle size, it is possible to reduce the scoop-up amount, without decreasing the development performance, and variation of the amount of developer is decreased even when flowability of the developer changes. As a result, in the feeding and conveying path 9, it is possible to feed the amount of developer such that can be scooped up with good stability, without exhausting the developer, and in the recovering and conveying path 7, the developer can be conveyed with good stability, without overflowing. Therefore, fluctuations with time and those caused by changes in environment can be reduced. As a result, stable developer circulation can be performed over a long period, and an image with excellent stability of image density can be obtained. Further, a magnetic brush in the development region becomes denser as the size of carrier particles decreases, feed efficiency of the toner to latent dots increases and an image with excellent dot reproducibility can be obtained. Therefore, image stability is increased over a long period.

Further, because bulk density of developer can be increased by reducing the particle size of the toner, the volume of developer necessary for developing can be decreased. Therefore, variations of developer volume can be reduced even when properties of the developer such as flowability vary. Moreover, because the particle size distribution is sharp, flowability of developer is improved. As a result, in the feeding and conveying path 9, it is possible to feed the amount of developer such that can be scooped up with good stability, without exhausting the developer, and in the recovering and conveying path 7, the developer can be conveyed with good stability, without overflowing. Therefore, fluctuations with time and those caused by changes in environment can be reduced. As a result, stable developer circulation can be performed over a long period, and an image with excellent stability of image density can be obtained. Further, by reducing the particle size of the toner, a finer toner image can be formed with respect to the latent image, and image with excellent dot reproducibility can be obtained. Therefore, image stability can be increased over a long period.

By making toner particles close in shape to spheres, the bulk density of developer can be reduced, and volume variations of the conveyed developer are decreased even in the case where properties of the developer such as flowability vary. As a result, in the feeding and conveying path 9, it is possible to feed the amount of developer such that can be scooped up with good stability, without exhausting the developer, and in the recovering and conveying path 7, the developer can be conveyed with good stability, without overflowing. Therefore, fluctuations with time and those caused by changes in environment can be reduced. As a consequence, stable developer circulation can be performed over a long period, and an image with excellent stability of image density can be obtained. Further, because contact between the toner and photosensitive body 1 becomes more close to point contact and transfer efficiency is increased, dot reproducibility is improved and image stability over a long period is also increased.

With a toner obtained by externally adding microparticles with an average primary particle size of 50 nm or more to 500 nm or less and a bulk density of 0.3 g/cm$^3$ or more to the surface of toner base particles, the degree to which the externally added particles are embedded in the base particles is small and variations of developer properties such as flowability with time are reduced. As a result, in the feeding and conveying path 9, it is possible to feed the amount of developer such that can be scooped up with good stability, without exhausting the developer, and in the recovering and conveying path 7, the developer can be conveyed with good stability, without overflowing. Therefore, fluctuations with time and those caused by changes in environment can be reduced. As a consequence, stable developer circulation can be performed over a long period, and an image with excellent stability of image density can be obtained.

As described hereinabove, with the present invention, local decrease in toner concentration of the developer that is fed on a developer support can be inhibited. Therefore, image formation with stable image density can be performed. Further, by inhibiting the degradation of developer when the developer is circulated and conveyed inside the device, it is possible to attain another excellent effect, that is, enable the extension of developer service life.

Various modifications will become possible for those skilled in the art after receiving the teachings of the present disclosure without departing from the scope thereof.

What is claimed is:

1. A developing device, comprising:

a developer support that supports on a surface thereof a developer including a magnetic carrier and a toner by a plurality of magnetic poles provided inside the developer support, and feeds the toner to a latent image on a surface of a latent image support in a location facing the latent image support by rotation of the surface of the developer support;

a developer feeding and conveying member that conveys the developer in an axial direction of a rotary shaft thereof by rotation of the rotary shaft about center thereof and feeds the developer to the developer support;

a developer recovering and conveying member that conveys the developer recovered from the developer support after the developer support passes the location facing the latent image support in an axial direction of a rotary shaft thereof by rotation of the rotary shaft about center thereof; and a developer stirring and conveying member that receives a feed of an excess developer that is conveyed to the downstreammost side in the conveying direction of the developer feeding and conveying member, without being fed to the developer support, and a recovered developer that is recovered from the developer support and conveyed to the downstreammost side in the conveying direction of the developer recovering and conveying member, conveys the excess developer and the recovered developer, while stirring the two developers, in an axial direction of a rotary shaft thereof by rotation of the rotary shaft about center thereof and feeds the developers to the uppermost side in the conveying direction of the developer feeding and conveying member, wherein spaces are provided where three development conveying members are located, the three development conveying members are the developer feeding and conveying member, the developer recovering and conveying member, and the developer stirring and conveying member, the spaces are partitioned by a casing and form three developer conveying paths, the three developer conveying paths include a developer recovering and conveying path having the developer recovering and conveying member disposed therein, a developer feeding and conveying path having the developer feeding and conveying member disposed therein, and a developer stirring and conveying path having the developer stirring and conveying member disposed therein, a central position of the rotary shaft of the developer recovering and conveying member is higher than a central position of the rotary shaft of the developer stirring and conveying member and a central position of the rotary shaft of the developer feeding and conveying member, and the central position of the rotary shaft of the developer recovering and conveying member is lower than a central position of a rotary shaft of the developer support.

2. The developing device as claimed in claim 1, further comprising a recovery partition wall that partitions the developer support and the developer recovering and conveying member as a casing forming the developer recovering and conveying path, wherein the recovery partition wall is not in contact with the casing of an upper portion forming the recovering and conveying path.

3. The developing device as claimed in claim 2, wherein an upper end of the recovery partition wall is in a position higher than the central position of the rotary shaft of the developer recovering and conveying member.

4. The developing device as claimed in claim 2, wherein an upper end of the recovery partition wall is in a position lower than the central position of the rotary shaft of the developer support.

5. The developing device as claimed in claim 2, wherein an angle between an upper end portion of the recovery partition wall on a side of the developer recovering and conveying member and a horizontal plane thereof is 60 degrees or more.

6. The developing device as claimed in claim 2, wherein a magnetic flux density in a normal direction on a surface of the developer support that faces an upper end of the recovery partition wall is 10 mT or less.

7. The developing device as claimed in claim 2, wherein a gap of a predetermined size is provided between an upper end of the recovery partition wall and a surface of the developer support.

8. The developing device as claimed in claim 1, wherein the central position of the rotary shaft of the developer stirring and conveying member and the central position of the rotary shaft of the developer feeding and conveying member are arranged at substantially the same height.

9. The developing device as claimed in claim 1, wherein the developer recovering and conveying member is in a shape of a screw comprising a spiral blade on the rotary shaft, the blade on a side of the developer support with respect to the rotary shaft moves from above to below, and the blade on a side opposite that of the developer support with respect to the rotary shaft moves from below to above.

10. The developing device as claimed in claim 1, wherein an outer diameter of the developer recovering and conveying member is larger than an outer diameter of the developer feeding and conveying member and the developer stirring and conveying member.

11. The developing device as claimed in claim 1, wherein an opening for transferring the recovered developer from the developer recovering and conveying path to the developer stirring and conveying path is provided in a casing that forms the developer recovering and conveying path.

12. The developing device as claimed in claim 1, wherein the developer feeding and conveying member is in a shape of a screw comprising a spiral blade on the rotary shaft, and a pitch width of the blade on the downstream side in the conveying direction of the developer feeding and conveying member is less than that on the upstream side in the conveying direction of the developer feeding and conveying member.

13. The developing device as claimed in claim 1, wherein a revolution speed of the developer feeding and conveying member, the developer stirring and conveying member, and the developer recovering and conveying member is not more than 1.5 times a revolution speed of the developer support.

14. The developing device as claimed in claim 1, wherein end portions of the developer feeding and conveying path and the developer recovering and conveying path on the downstream side in the conveying direction are linked to the end portion of the developer stirring and conveying path on the upstream side in the conveying direction, and an end portion of the developer stirring and conveying path on the downstream side is linked to an end portion of the developer feeding and conveying path on the upstream side in the conveying direction.

15. The developing device as claimed in claim 14, further comprising developer feed means for feeding an unused developer including at least an unused toner to the developer conveying path, wherein the unused developer is fed by the developer feed means into the developer recovering and conveying path on an upstream side of a linking portion of the developer recovering and conveying path and the developer stirring and conveying path, in the conveying direction of the developer recovering and conveying path.

16. The developing device as claimed in claim 14, further comprising developer feed means for feeding an unused developer including at least an unused toner to the developer conveying path, wherein the unused developer is fed by the developer feed means above a linking portion of the developer recovering and conveying path and the developer stirring and conveying path.

17. An image forming apparatus comprising at least:

a latent image support;

a charging device for charging a surface of the latent image support;

an exposure device for forming an electrostatic latent image on the latent image support; and a developing device for developing the electrostatic latent image, the developing device, including:

a developer support that supports on a surface thereof a developer including a magnetic carrier and a toner by a plurality of magnetic poles provided inside the developer support, and feeds the toner to the electrostatic latent image on the surface of the latent image support in a location facing the latent image support by rotation of the surface of the developer support;

a developer feeding and conveying member that conveys the developer in an axial direction of a rotary shaft thereof by rotation of the rotary shaft about center thereof and feeds the developer to the developer support;

a developer recovering and conveying member that conveys the developer recovered from the developer support after the developer support passes the location facing the latent image support in an axial direction of a rotary shaft thereof by rotation of the rotary shaft about center thereof; and a developer stirring and conveying member that receives a feed of an excess developer that is conveyed to the downstreammost side in the conveying direction of the developer feeding and conveying member, without being fed to the developer support, and a recovered developer that is recovered from the developer support and conveyed to the downstreammost side in the conveying direction of the developer recovering and conveying member, conveys the excess developer and the recovered developer, while stirring the two developers, in an axial direction of a rotary shaft thereof by rotation of the rotary shaft about center thereof, and feeds the developers to the uppermost side in the conveying direction of the developer feeding and conveying member, wherein spaces are provided where three development conveying members are located, the three development conveying members are the developer feeding and conveying member, the developer recovering and conveying member, and the developer stirring and conveying member, the spaces are partitioned by a casing and form three developer conveying paths, the three developer conveying paths include a developer recovering and conveying path having the developer recovering and conveying member disposed therein, a developer feeding and conveying path having the developer feeding and conveying member disposed therein, and a developer stirring and conveying path having the developer stirring and conveying member disposed therein, a central position of the rotary shaft of the developer recovering and conveying member is higher than a central position of the rotary shaft of the developer stirring and conveying member and a central position of the rotary shaft of the developer feeding and conveying member, and the central position of the rotary shaft of the developer recovering and conveying member is lower than a central position of a rotary shaft of the developer support.

18. The image forming apparatus as claimed in claim 17, comprising a plurality of developing devices with mutually different toner colors for the developing devices.

19. The image forming apparatus as claimed in claim 17, wherein end portions of the developer feeding and conveying path and the developer recovering and conveying path on the downstream side in the conveying direction are linked to the end portion of the developer stirring and conveying path on the upstream side in the conveying direction, and an end portion of the developer stirring and conveying path on the downstream side is linked to an end portion of the developer feeding and conveying path on the upstream side in the conveying direction.

* * * * *